US006779229B2

(12) United States Patent
Lee et al.

(10) Patent No.: US 6,779,229 B2
(45) Date of Patent: Aug. 24, 2004

(54) VERSATILE VACUUM CLEANER

(75) Inventors: Nam-Ho Lee, Incheon (KR); Jae-Duck Lee, Seoul (KR); Min-Ho Park, Koyang-si (KR); Im-Suk Choi, Incheon (KR)

(73) Assignee: Daewoo Electronics Corporation, Seoul (KR)

( * ) Notice: Subject to any disclaimer, the term of this patent is extended or adjusted under 35 U.S.C. 154(b) by 0 days.

(21) Appl. No.: 09/773,050

(22) Filed: Jan. 31, 2001

(65) Prior Publication Data

US 2004/0006842 A1 Jan. 15, 2004

(30) Foreign Application Priority Data

Sep. 22, 2000 (KR) ..... 2000-55734

(51) Int. Cl.[7] ..... A47L 9/26

(52) U.S. Cl. ..... 15/329; 15/323; 15/338; 15/334; 15/410

(58) Field of Search ..... 15/327.5, 328, 15/323, 329, 338, 331, 410, 334

(56) References Cited

U.S. PATENT DOCUMENTS

| | | | | | |
|---|---|---|---|---|---|
| 1,129,174 | A | * | 2/1915 | Dennis | 15/334 |
| 1,997,754 | A | * | 4/1935 | Sharp | 15/328 |
| 2,046,684 | A | * | 7/1936 | Hoover | 15/334 |
| 2,729,303 | A | * | 1/1956 | McMahan | 15/329 |
| 3,039,130 | A | * | 6/1962 | Belicka et al. | 15/410 |
| 4,660,246 | A | | 4/1987 | Duncan et al. | 15/329 |
| 4,811,452 | A | | 3/1989 | Sumerau | 15/337 |
| 6,295,692 | B1 | * | 10/2001 | Shideler | 15/327.5 |

* cited by examiner

*Primary Examiner*—Theresa T. Snider
(74) *Attorney, Agent, or Firm*—Harness, Dickey & Pierce, P.L.C.

(57) ABSTRACT

An versatile vacuum cleaner is disclosed which comprises a main body, a socket, a first cleaner, a second cleaner, a motor assembly, a cord reel, a handle, and an exhaust duct, and can be converted easily into different configurations each suitable for a specifically different type of vacuum cleaning operation. Improvements are made in details such as the arrangement or the configuration of the main body, the socket, the first cleaner, the second cleaner, the cord reel, the handle, and exhaust duct, thereby improving the operability of the vacuum cleaner and improving the performance thereof.

16 Claims, 30 Drawing Sheets

VERSATILE VACUUM CLEANER

BACKGROUND OF THE INVENTION

1. Field of the Invention

The present invention relates generally to vacuum cleaners, and more particularly to an improved versatile vacuum cleaner which can be converted easily into different configurations each suitable for a specifically different type of vacuum cleaning operation.

2. Description of the Related Art

A vacuum cleaner is an electrically powered mechanical appliance for the dry removal of dust and loose dirt from rugs, fabrics, and other surfaces.

Vacuum cleaners are basically classified into either a canister type vacuum cleaner or an upright type vacuum cleaner.

Generally, the canister type vacuum cleaner is comprised of a main body, which generally has a dust collecting chamber and a driving chamber, and an elongated suction pipe connected to the dust collecting chamber of the main body. A motor for providing suction force is installed in the driving chamber. An elongated suction pipe has a flexible hose at the center portion thereof.

Dust is sucked through the elongated suction pipe by changing the suction opening at the tip end thereof, so it can easily clean any corner part of a room, especially a narrow space.

However, a user should move the suction pipe and the main body together, which is inconvenient for the user. Furthermore, it is unsuitable for the user when cleaning a wide area.

Generally, the upright type vacuum cleaner is comprised of a main body, which generally has a dust collecting chamber and a driving chamber, a brush head which is attached to the lower end of the main body so as to be connected to the dust collecting chamber, and a handle provided at the upper end of the main body. The brush head has wheels provided at the lower surface thereof, and a suction port in which dust on a floor is sucked. User can clean easily from place to place while moving the main body by the wheels. Therefore, it is convenient for the user to clean in a wide area.

However, the upright type vacuum cleaner cannot be operated effectively in relatively narrow spaces like corners of a room, because dust is sucked through the brush head which is attached to the lower end of the main body.

In order to solve the drawback, vacuum cleaners have been proposed to become convertible between upright type and canister type as disclosed in U.S. Pat. No. 4,660,246 of The Singer Company, which was issued Apr. 28, 1987, and U.S. Pat. No. 4,811,452 of Ryobi Motor Products Corp. & Pickens, S. C., which was issued Mar. 14, 1989 etc.

But, it is inconvenient for the user to convert one type into the other type and to use the vacuum cleaner. Furthermore, these prior arts reduce the effectiveness of the cleaning operation and generate noise due to their structural inferiority.

SUMMARY

To solve the above problems, it is an object of this invention to provide a vacuum cleaner which can be converted easily and quickly into configuration suitable for canister type vacuum cleaning operation, upright type vacuum cleaning operation, or another type vacuum cleaning operation.

It is a further object of this invention to provide a vacuum cleaner which has various cleaning means suitable for different cleaning areas and which can stand stably in an upright position.

It is an additional object of this invention to provide a vacuum cleaner which has an improved cord reel and an exhaust duct for reducing noise.

In order to accomplish the above objects, a vacuum cleaner is provided comprising:

a main body having a suction opening for sucking therein and an exhaust grill for exhausting air, the main body having a dust collecting chamber, a driving chamber, and a cord reel chamber provided successively by partitions; a socket adapted to a lower end of the main body and having a connecting opening communicating with the dust collecting chamber; a first cleaner connected detachably to the connecting opening of the socket; a second cleaner installed pivotally on a portion of the socket and connected detachably to the connecting opening of the socket; a motor assembly installed in the driving chamber for providing suction force; a cord reel installed in the cord reel chamber for winding up a power cord that supplies power to the motor assembly; and a handle adapted to an upper end of the main body in a retractable manner.

These and other features, aspects, and advantages of the present invention will become better understood with regard to the following description, appended claims, and accompanying drawings.

DESCRIPTION

Hereinafter, preferred embodiments according to the present invention will be described in detail with reference to the drawings.

Figure 1:
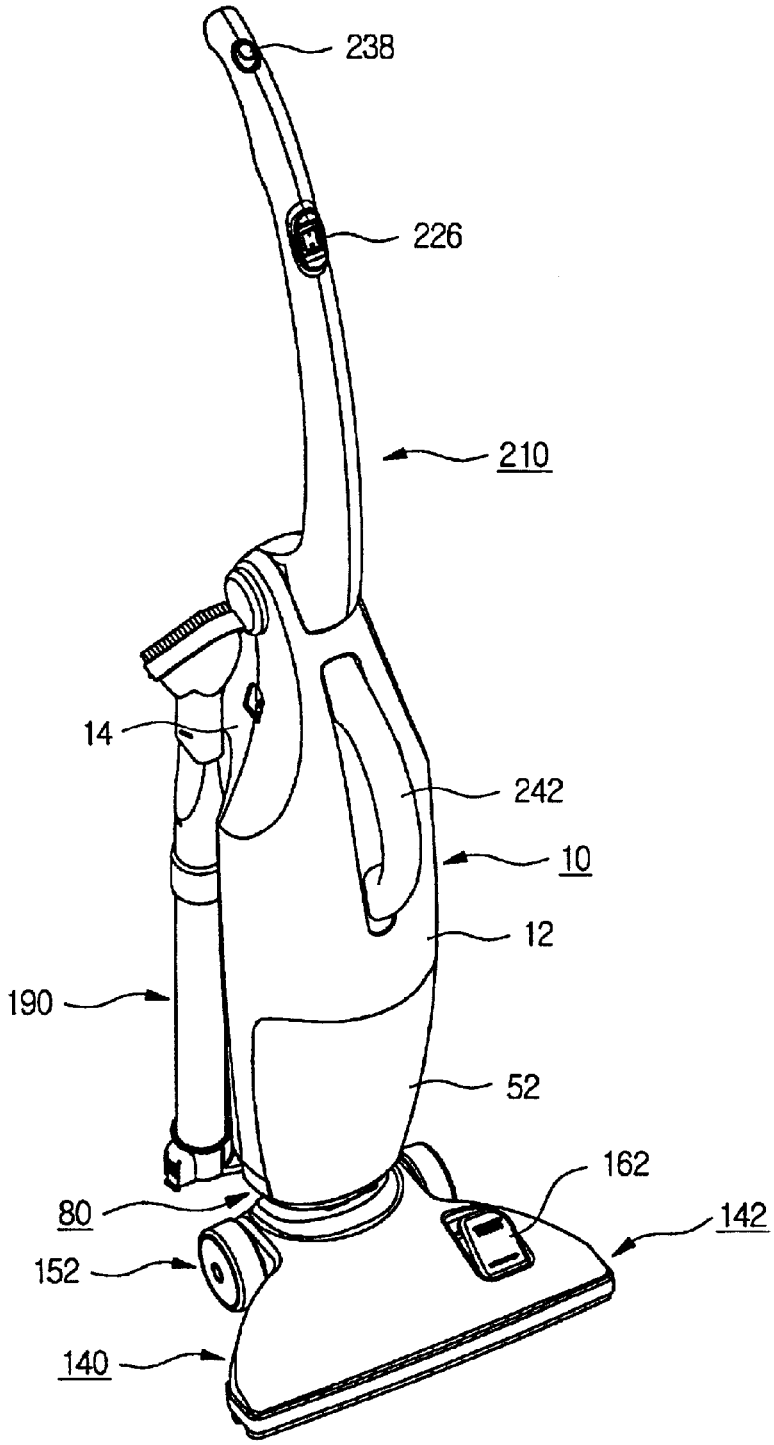
FIG. 1 is a perspective view showing a vacuum cleaner according to an embodiment of the present invention.
Figure 2:
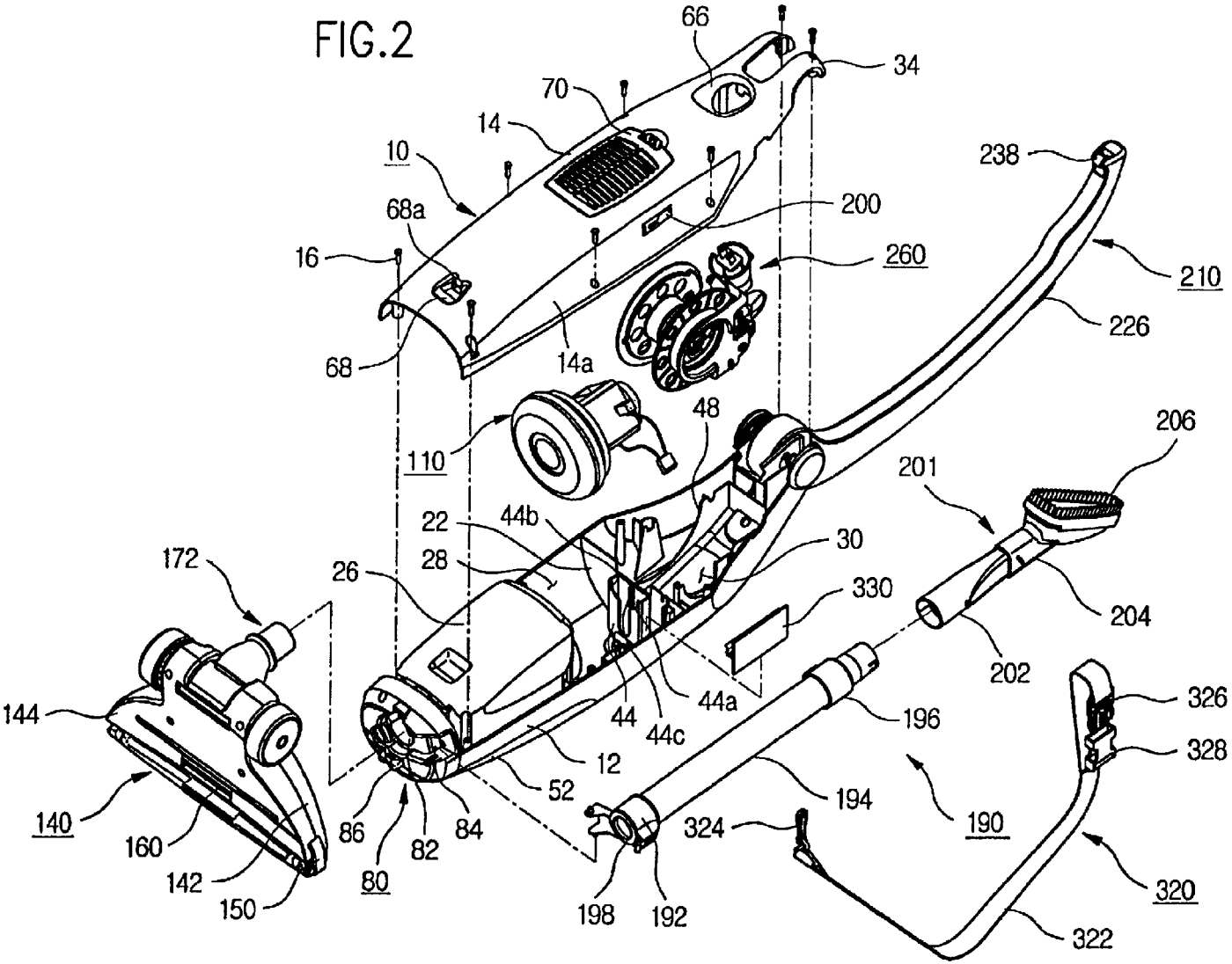
FIG. 2 is an exploded perspective view showing the vacuum cleaner of FIG. 1.

FIG. 1 is a perspective view showing a vacuum cleaner according to an embodiment of the present invention, and FIG. 2 is an exploded perspective view showing the vacuum cleaner of FIG. 1.

As shown in FIGS. 1 and 2, the vacuum cleaner according to an embodiment of the present invention is comprised of a main body 10, a socket 80, a first cleaner 140, a second cleaner 190, a motor assembly 110, a cord reel 260, a handle 210, an exhaust duct 120 (shown in FIG. 20), a dust filtering means 100 (shown in FIG. 3 and FIG. 5*a*), an auxiliary handle 242, and a shoulder belt 320.

Figure 3:
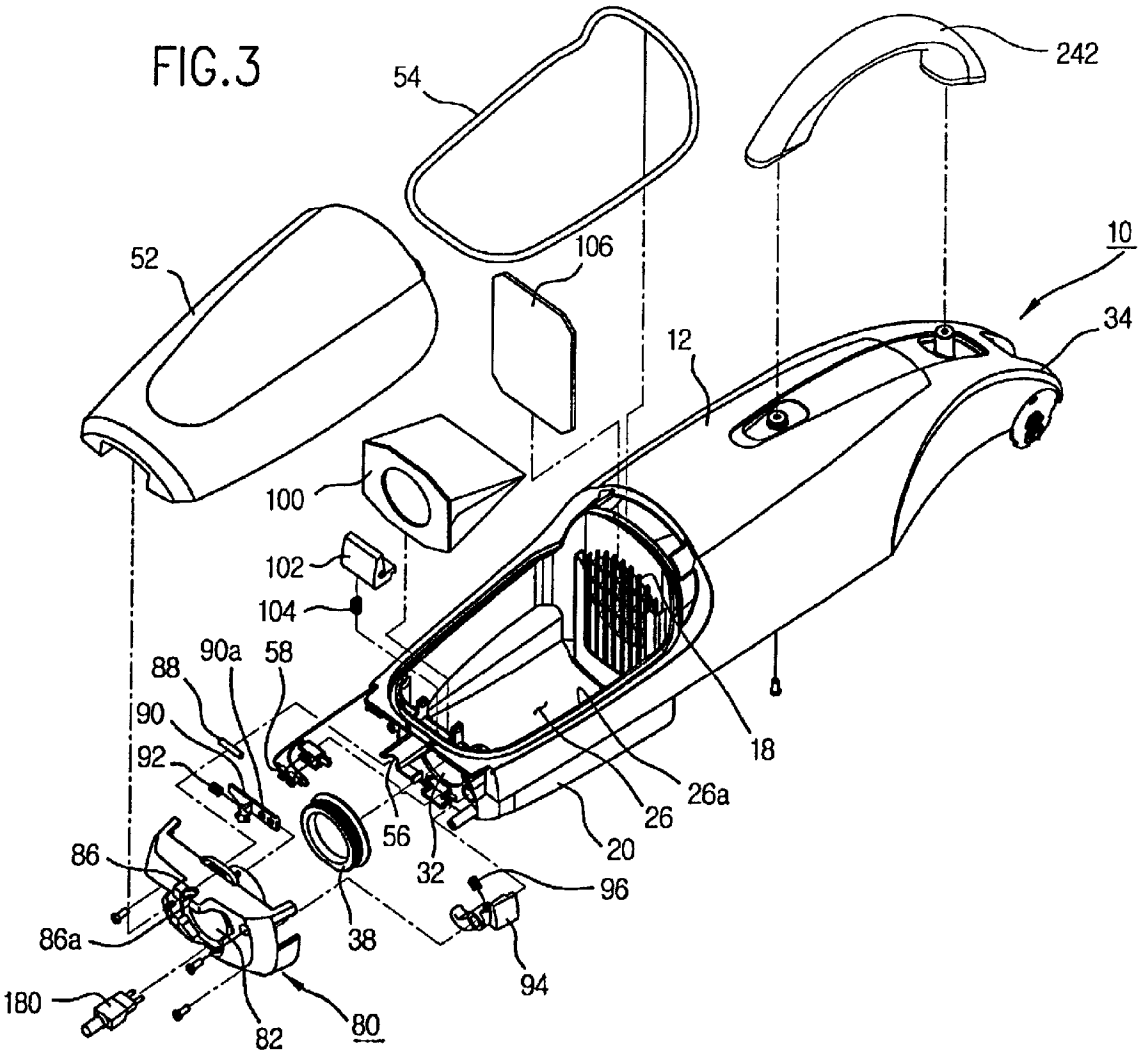
FIG. 3 is a perspective view showing a first body of a main body and a socket of the vacuum cleaner of FIG. 1.
Figure 4:
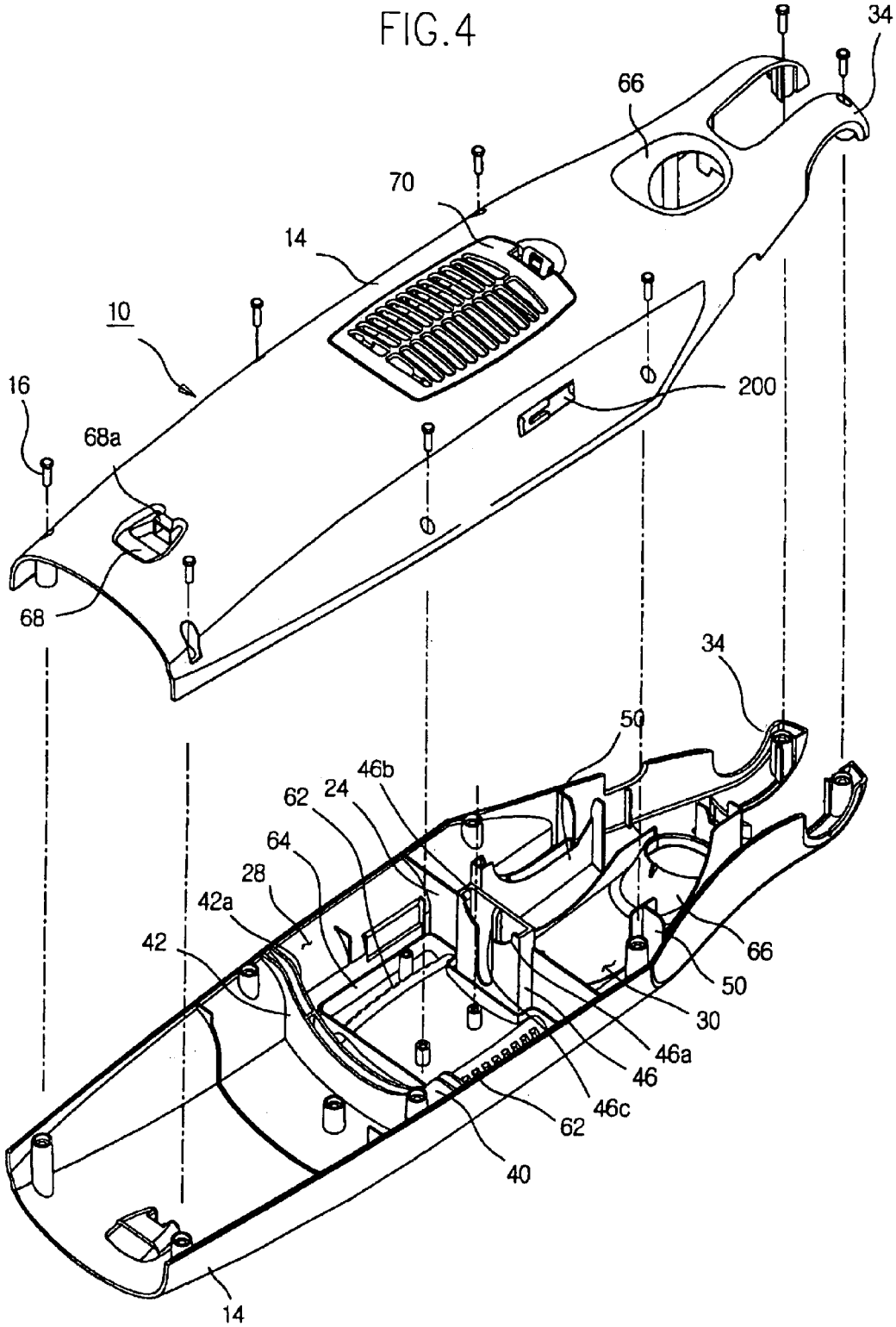
FIG. 4 is a perspective view showing the first body and a second body of the vacuum cleaner of FIG. 1.

As shown in FIGS. 2, 3, and 4, the main body 10 is shaped substantially like a cylinder with long straight sides. The main body 10 is comprised of a first body 12 and a second body 14. The first body 12 and the second body 14 are assembled using fasteners such as screws.

The main body 10 has a dust collecting chamber 26 to accommodate dust collecting means, a driving chamber 28 to accommodate the motor assembly 110, and a cord reel chamber 30 to accommodate the cord reel 260. A grill partition 18 separates the dust collecting chamber 26 and the driving chamber 28, and first and second partitions 22 and 24 separate the driving chamber 28 and the cord reel chamber 30.

The main body 10 has a suction opening 32 at the lower end thereof that communicates with the dust collecting chamber 26. A check valve 38 is installed in the suction opening 32 to prevent dust in the dust collecting chamber 26 from flowing backward. The main body 10 has a fork end 34, which bifurcates, formed at the upper end thereof. The handle 210 is inserted into and connected hingedly to the fork end 34.

Protrusion pipes 36*a* and 36*b* are formed integrally with the back side of the grill partition 18 to support the motor assembly 110. The protrusion pipes 36*a* and 36*b* are a passage through which air is sucked into the driving chamber 28, and concentric with each other. (shown in FIG. 15)

The first partition 22 and the second partition 24 have a first supporting block 44 and a second supporting block 46 protruding thereon to face each other to support the motor assembly 110 respectively. The first supporting block 44 and the second supporting block 46 have a semicircular first supporting portion 44*a* and a semicircular second supporting portion 46*a* formed at the front thereof respectively, and the first and second supporting blocks have a first straight line portion 44*b* and a second straight line portion 46*b* extending upward at the upper portion thereof respectively. A first supporting protrusion 44*c* and a second supporting protrusion 46*c* protrude vertically inside of the back sides of the first supporting block 44 and the second supporting block 46 respectively.

A plurality of first supporting ribs 40 and a plurality of second supporting ribs 42 which extend vertically are provided on the side walls of the driving chamber 28, and a plurality of third supporting ribs 48 and a plurality of fourth supporting ribs 50 which extend vertically are provided on the side walls of the cord reel chamber 30 to support the cord reel 260.

As shown in FIG. 3, an entrance 26*a* of the dust collecting chamber 26 is provided at the lower portion of the outer surface of the first body 12. The entrance 26*a* of the dust collecting chamber 26 is covered with a cover 52. An annular packing 54 is provided between the entrance 26*a* of the dust collecting chamber 26 and the cover 52 to prevent air from getting in or out.

A projection member 56 protrudes on the upper portion of the lower end of the first body 12 to be inserted into a portion of the socket 80. A pair of terminals 58 are provided at the lower portion of the lower end of the first body 12. When an electrically-operated brush head (not shown) is provided, the terminals 58 supply power to the electrically-operated brush head.

Figure 5A:
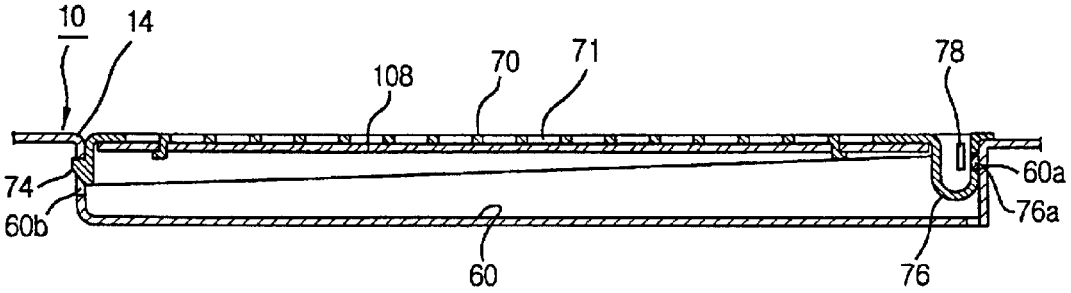
FIGS. 5*a* and 5*b* are a sectional view and a plan view showing a grill cover covering a depressed area located at the main body of the vacuum cleaner of FIG. 1 respectively.
Figure 5B:
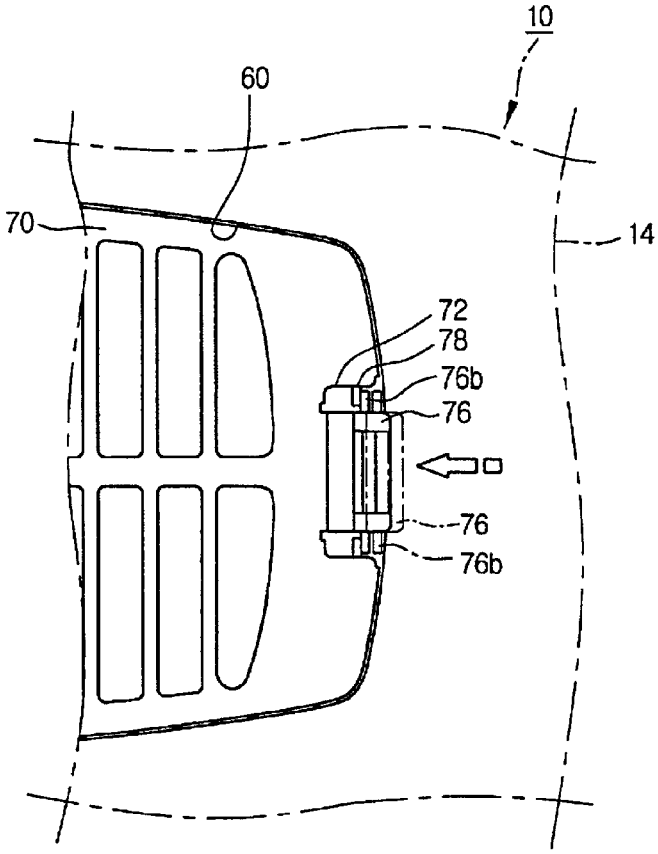

As shown in FIGS. 4 to 5*b*, an area 60 depressed toward the driving chamber 28 is provided to the outer surface of the second body 14. The depressed area 60 has a first locking protrusion 60*a* at the upper side thereof and a first locking hole 60*b* at the lower side thereof. Exhaust grills 62 which communicate with the driving chamber 28 are formed at the lefthand and righthand sides of the depressed area 60. A coupling rib 64 which surrounds the opposite side of the depressed area 60 is formed in the driving chamber 28 of the second body 14. The exhaust duct 120 is fixed to the coupling rib 64.

A grill cover 70 covers the depressed area 60. The grill cover 70 has a plurality of apertures 71 to exhaust air. The grill cover 70 has a square cut-off portion 72 at an end thereof and a second locking protrusion 74 which is inserted into the first locking hole 60*b* of the depressed area 60 and is formed at the other end thereof. A tension lock 76 which is shaped substantially like a letter U is formed integrally with the cut-off portion 72. The tension lock 76 has a second locking hole 76*a* provided at the front plane thereof and a first stopper 76*b* protruding on both sides. The first locking protrusion 60*a* is inserted into the second locking hole 76*a*. The cut-off portion 72 has a second stopper 78 protruding on both sides thereof to restrict the operating position of the tension lock 76.

As shown in FIG. 4, when a user presses the tension lock 76, the first stopper 76*b* is engaged with the second stopper 78 and the operating position of the tension lock 76 is restricted within predetermined ranges. Therefore, it prevents the tension lock 76 from plastic deformation and breakage.

The depressed area 60 enables noise generated from the operation of the motor assembly 110 to decrease.

A cord inlet 66 which communicates with the cord reel chamber 30 is provided at the upper portion of the outer surface of the second body 14. A power cord 250 is wound up on the cord reel 260 via the cord inlet 66. A handle locking hole 68 having a handle locking protrusion 68*a* is provided at the lower portion of the outer surface of the second body 14. The handle 190 is fixed to the second body 14 by handle locking protrusion 68*a*.

The second body 14 has a concave portion 14*a* which is formed at the side of the second body 14 along the longitudinal direction thereof. A clip 200 is attached to the concave portion 14*a* to attach the second cleaner 190 to the second body 14. The second cleaner 190 is located in the concave portion 14*a* when it is not used.

The main body 10 has at least one dust filtering means for filtering air. The filtering means is comprised of a dust bag 100, a first filter 106, and a second filter 108.

As shown in FIG. 3, the dust bag 100 is installed in the suction opening 32 which communicates with the connecting opening 82 of the socket 80. The dust bag 100 is clamped detachably in the dust collecting chamber 26 by clamping lever 102. The clamping lever 102 is urged in the direction of fixing the dust bag 100 by means of elastic means such as a spring 104. The clamping lever 102 can be substituted by another fixing means. The dust collected from the outside is sucked into the dust bag 100.

The first filter 106 is installed at the front of the grill partition 18. The first filter 106 prevents dust passing through the dust bag 100 from entering the driving chamber 28. Furthermore, when the dust bag 100 is torn by a piece of metal, etc., the first filter 106 prevents the dust from entering the driving chamber 28.

As shown in FIG. 5*a*, the second filter 108 is installed inside of the grill cover 70. The second filter 108 is a piece of equipment that filters air to be exhausted outside eventually. Especially, when materials of the motor brush are carbon, the second filter 108 filters the carbon powder, etc. The second filter 108 can be installed on the floor of the depressed area 60. Materials of the first and second filters can be polyester or polypropylene.

The socket 80 is attached to the lower end of the main body 10.

Figure 6:
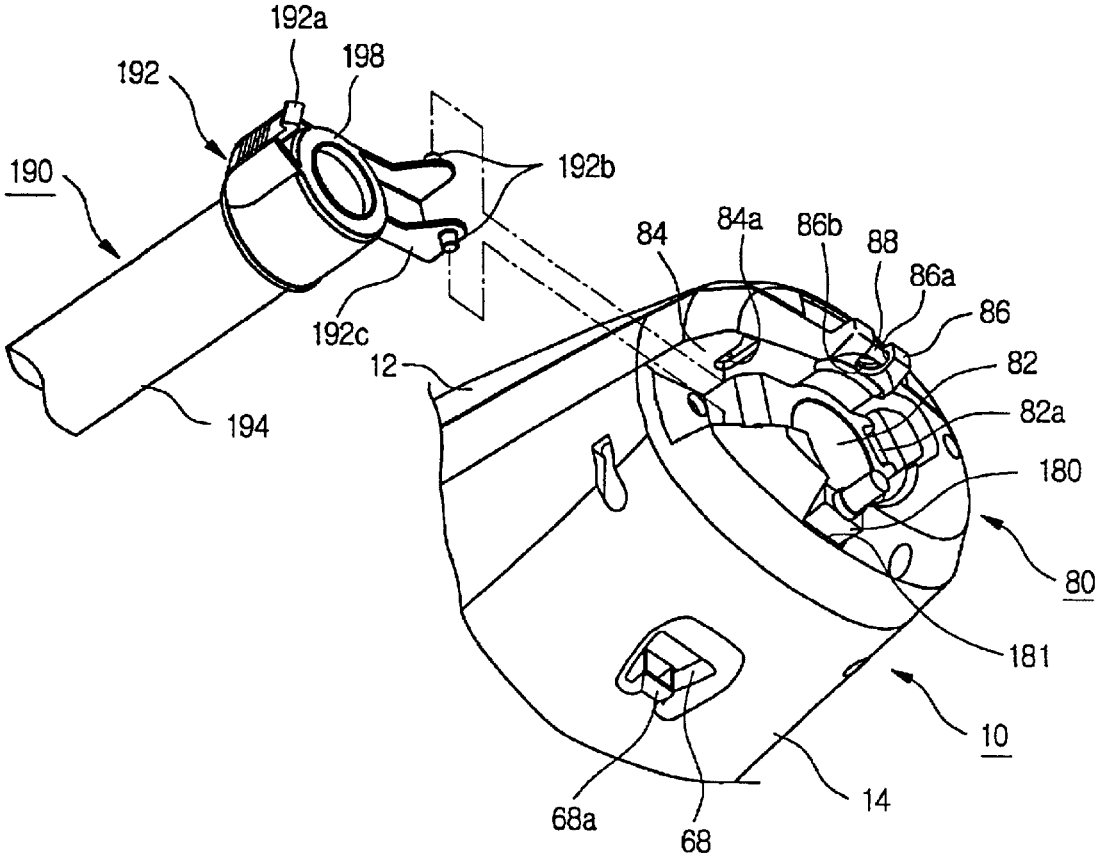
FIG. 6 is a perspective view showing the socket connected to a second adaptor of a second cleaner of the vacuum cleaner of FIG. 1.
Figure 7:
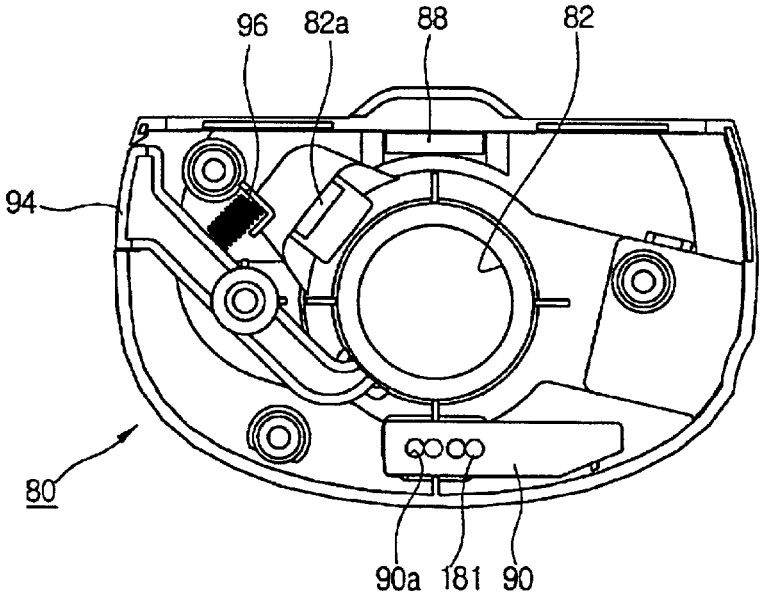
FIG. 7 is a rear elevation showing the socket shown in FIG. 6.

FIG. 6 is a perspective view showing the socket connected to a second adaptor of a second cleaner of the vacuum cleaner according to an embodiment of the present invention, and FIG. 7 is a rear elevation showing the socket shown in FIG. 6.

As shown in FIGS. 3, 6, and 7, the socket 80 is attached detachably to the lower end of the main body 10. The socket 80 has a connecting opening 82 at the center portion thereof, and the connecting opening 82 is connected to the suction opening 32 of the dust collecting chamber 26. The socket 80 has a guide groove 84 at the front plane thereof, and the guide groove 84 extends from the connecting opening 82. The guide groove 84 guides the second cleaner 190 when it is connected to the connecting opening 82.

The socket 80 has a first locking groove 82*a* beside the connecting opening 82 of the front plane thereof to fix the second cleaner 190. A positioning protrusion 86 having a fitting hole 86*a* protrudes from the upper portion of the connecting opening 82. The projection member of the first body 12 is inserted into the fitting hole 86*a*. The positioning protrusion 86 has a cut-off portion 86*b* at the center portion of the end thereof which is shaped substantially like a letter C, and a belt pin 88 is attached to the cut-off portion 86*b* which is exposed. The positioning protrusion 86 restricts the inclination of the main body 10 with respect to the first cleaner 140. The belt pin 88 is used when the shoulder belt 320 is fixed to the main body 10.

The socket 80 has a connector hole 181 provided at the lower portion of the connecting opening 82 of the front plane of the socket 80. A connector 180 connected electrically to the terminal 58 is inserted in the connector hole 181.

The guide groove 84 has hinge holes 84*a* at the inside of both sides thereof. As shown in FIG. 6, a second adaptor 192 of the second cleaner 190 is connected hingedly to the hinge holes 84*a*.

A plate button 90 having a pair of connecting apertures 90*a* is located in front of the connector hole 181 of the back side of the socket 80. The plate button 90 controls a connection of the terminal 58 and the connector 180. At normal times, the plate button 90 is urged in the direction of a break in the connection by means of an elastic means such as springs.

A locking button 94 which is exposed is installed at the outer surface of the opposite portion of the guide groove 84. The locking button 94 is urged toward the connecting opening 82. The locking button 94 is used when the first cleaner 140 is connected to the connecting opening 82.

The first cleaner 140 is attached separably to the socket 80.

Figure 8:
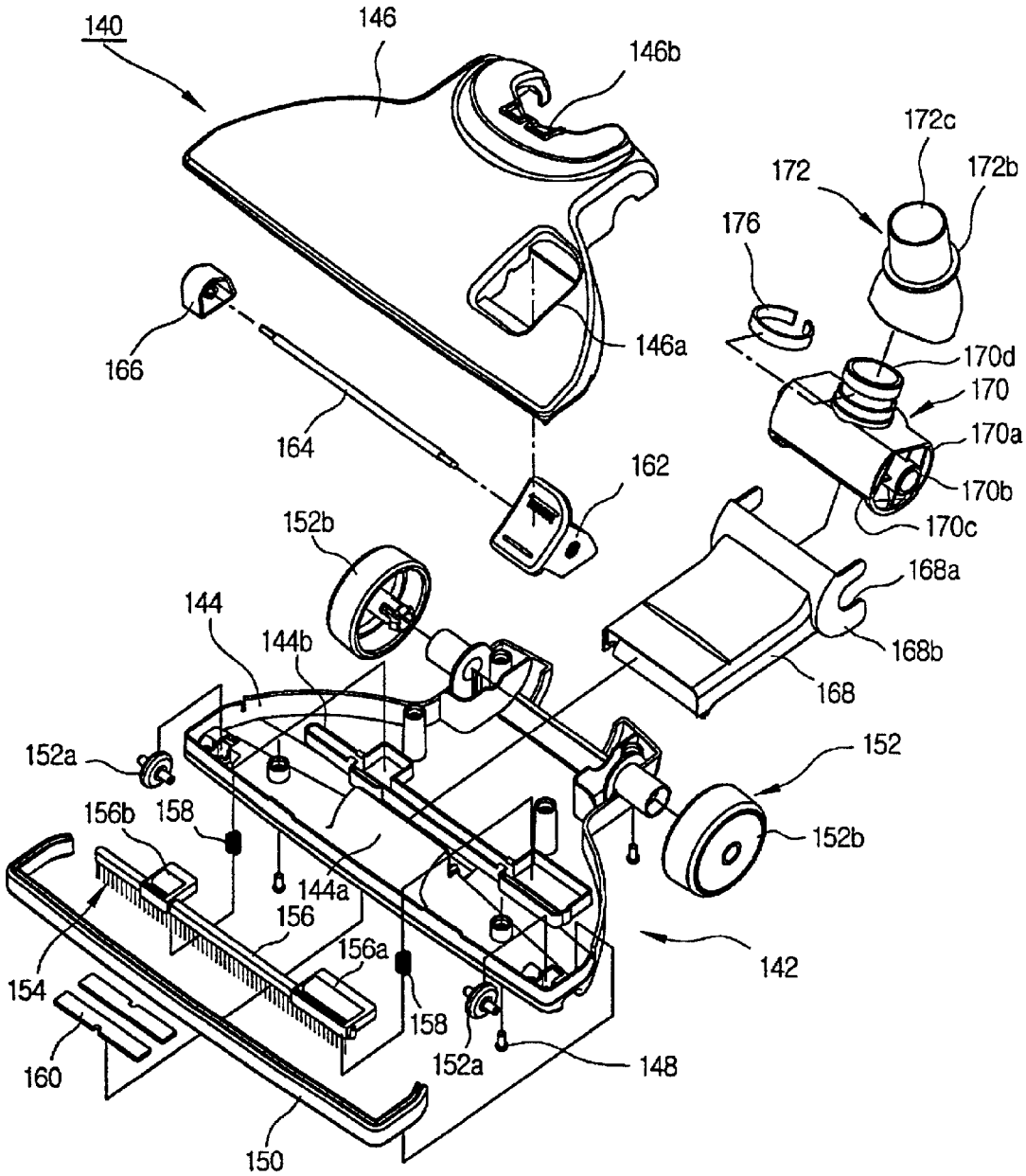
FIG. 8 is a exploded perspective view showing a first cleaner of the vacuum cleaner of FIG. 1.
Figure 9:
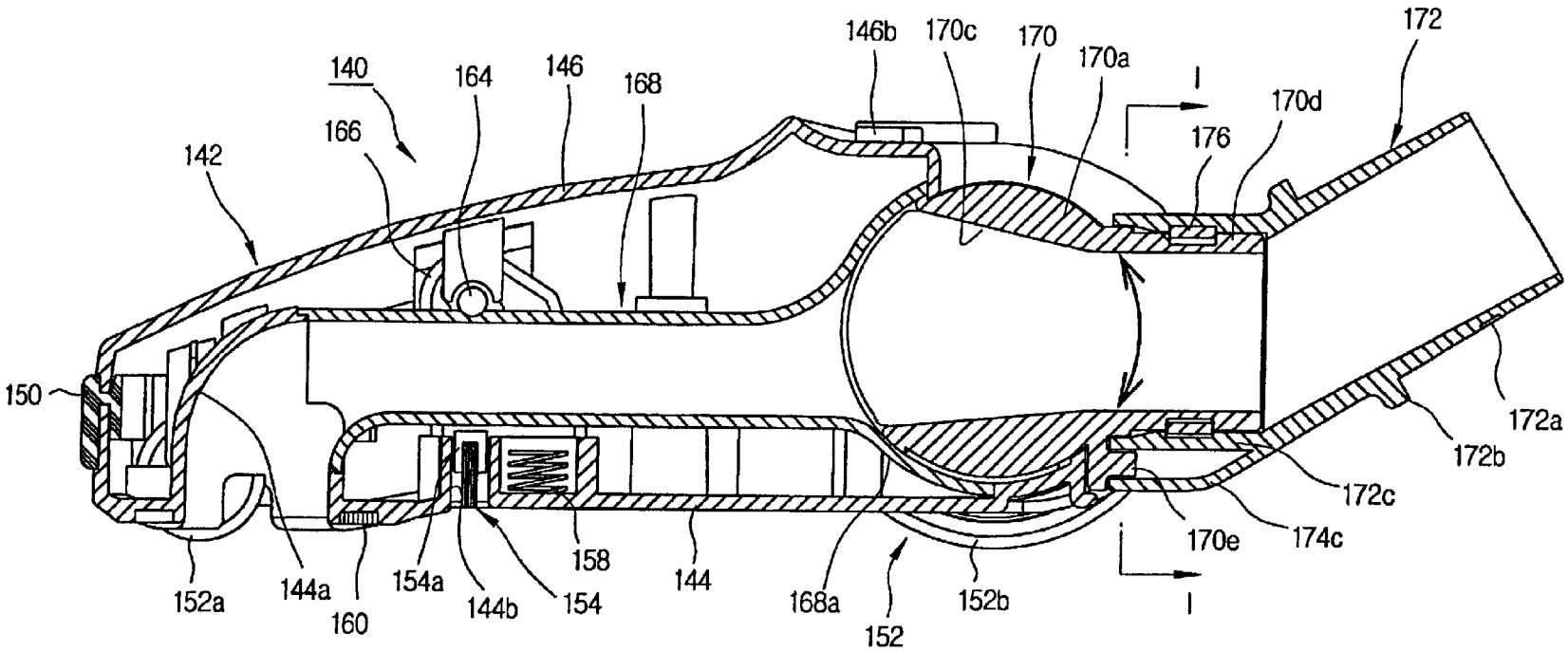
FIG. 9 is a vertical sectional view showing the first cleaner shown in FIG. 8.
Figure 10:
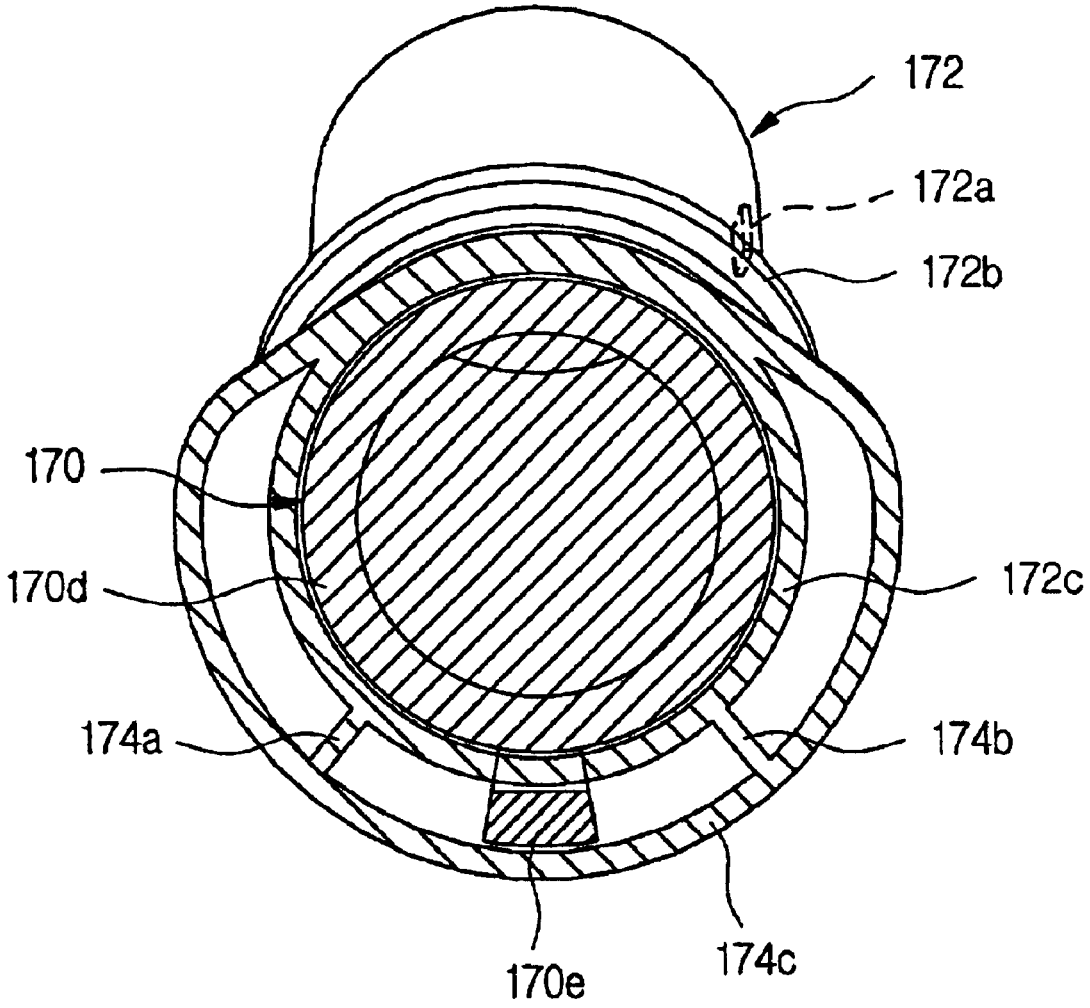
FIG. 10 is a sectional view taken substantially along the lines I—I of FIG. 9.

As shown in FIG. 8, the first cleaner 140 is comprised of a brush head 142, an inlet duct 168, a rotary duct 170, a first adaptor 172.

The brush head 142 is comprised of a head base 144 and a head cover 146. The head base 144 and the head cover 146 are assembled by locking means such as screws. The head base 144 has the suction port 144*a* located at a portion thereof and a long slot 144*b* located beside the suction port 144*a*.

A protector 150 made of flexible material is attached to the front side of the head base 144. The protector 150 provents the brush head 142 from being damaged due to a collision with any materials. The head base 144 has wheels 152 allowing the brush head 142 to move from place to place. The wheels 152 comprise a pair of front wheels 152*a* and a pair of rear wheels 152*b*. Here, it is desirable that the diameter of the rear wheels 152*b* is wider than that of the front wheels 152*a*.

As shown in FIG. 8, a first brush 154 is installed in the slot 144*b* in a retractable manner. The first brush 154 has a long movable brush body 156 inserted into the slot 144*b*. The movable brush body 156 has a main push plate 156*a* and a sub push plate 156*b* formed integrally at the both sides thereof respectively. The main push plate 156*a* and the sub push plate 156*b* are urged not to protrude from the lower end of the brush head 142 by means of a spring 158.

An auxiliary brush 160 is attached firmly between the suction port 144*a* and the slot 146*a*.

A cover hole 146*a* is provided on the head cover 146. The main push button 162 is installed in the cover hole 146*a* which is exposed. A connecting shaft 164 is connected to the main push button 162, and the sub push button 166 is connected to the other end of the connecting shaft 164 to move together with the main push button 162. The main push button 162 and the sub push button 166 operate the main push plate 156*a* and the sub push plate 156*b* respectively and make the first brush 154 protrude from the lower surface of the head base 144.

When the first brush 154 protrudes from the lower surface of the head base 144, dust on the floor is collected by the first brush 154. Meanwhile, when the first brush 154 is retracted into the slot 144*b*, dust on the floor is collected by the second brush 154.

The head cover 146 has a positioning protrusion 86, which supports the positioning portion 146*b*, at the rear portion of the upper surface thereof. A protruding edge is formed around the surroundings except in one portion.

The inlet duct 168 communicates with the suction port 144*a* of the head base 144. A semicircular divergent portion 168*b* having a shaft bearing portion 168*a* is provided at the rear end of the inlet duct 168. One portion of the shaft bearing portion 168*a* is opened to receive a shaft 170*b* of the rotary duct 170.

The rotary duct 170 has a cylindrical portion 170*a* which is fixed rotatably to the divergent portion 168*b*. The cylindrical portion 170*a* has shafts at the both sides thereof. A connecting passage 170*c* communicating with the inlet duct 168 is provided inside the cylindrical portion 170*a*. The cylindrical portion 170*a* has a first connecting pipe 170*d*, which communicates with the connecting passage 170*c*, at the outer portion thereof. A rotation stopper 170*e* protrudes from the lower portion of the outer surface of the first connecting pipe 170*d* to restrict the rotation angle of the first adaptor 172.

The shaft 170*b* is fixed rotatably into the shaft bearing portion 168*a*, so the rotary duct 170 can rotate in a vertical manner.

The first adaptor 172 is connected rotatably to the rotary duct 170 in a horizontal manner and is connected detachably to the connecting opening 82. A second locking groove 172*a* is provided at the upper portion of the outer surface of the first adaptor 172 to receive the locking button 94 of the socket 80. A flange 172*b* protrudes from the center portion of the outer portion of the first adaptor 172 to restrict the depth of connection of the socket 80. The first adaptor 172 has a second connecting pipe 172*c*, which is connected rotatably to the first connecting pipe 170*d*, at the lower portion thereof. The second connecting pipe 172*c* has a reinforcing portion 174*c* formed at the lower portion of the outer surface thereof. A first stop rib 174*a* and a second stop rib 174*b* are formed symmetrically between the second connecting pipe 172*c* and the reinforcing portion 174*c* to restrict the rotation angle of the first adapter 172 with respect to the rotary duct 170 by being engaged with the rotation stopper 170*e*. It is desirable that the first stop rib 174*a* and the second stop rib 174*b* restrict a rotation angle of the first adaptor 172 to 30 degrees. A connecting ring 176 is located between the first connecting pipe 170*d* and the second connecting pipe 172*c* to prevent the first adaptor 172 from separating from the rotary duct 170.

Meanwhile, an electrically-operated brush head (not shown) having a rotary brush, can be provided to the first cleaner 140. The connector 180 of the socket 80 supplies power to the electrically-operated brush head.

Figure 11A:
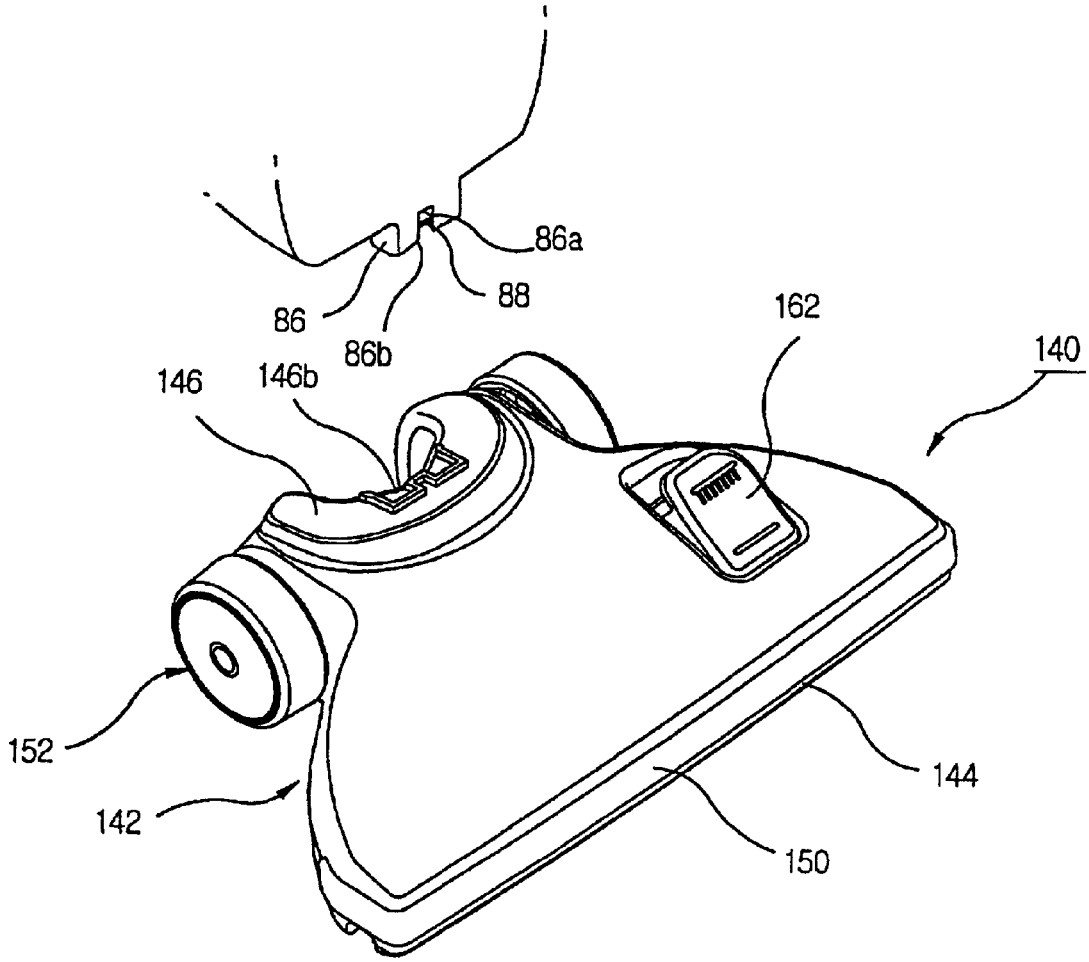
FIGS. 11*a* and 11*b* are a perspective view and a vertical sectional view showing a positioning means fixing the main body to the first cleaner respectively.
Figure 11B:
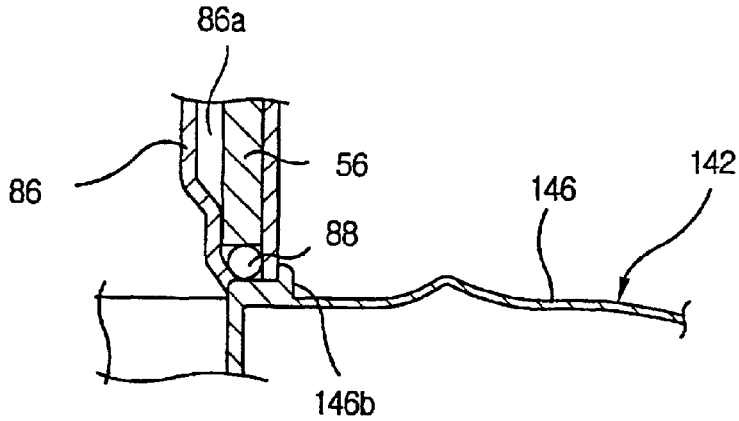

As shown in FIGS. 11*a* and 11*b*, the positioning protrusion of the socket 80 is supported by the positioning portion 146*c* of the head cover 146. The center of gravity of the main body 10 lies approximately at the center of the brush head 142, so the main body 10 can stably stand in an upright position. The angle of the main body 10 with respect to a floor is desirable between 83 to 85 degrees.

The second cleaner 190 is connected hingedly to the outer surface of the socket 80.

Figure 12:
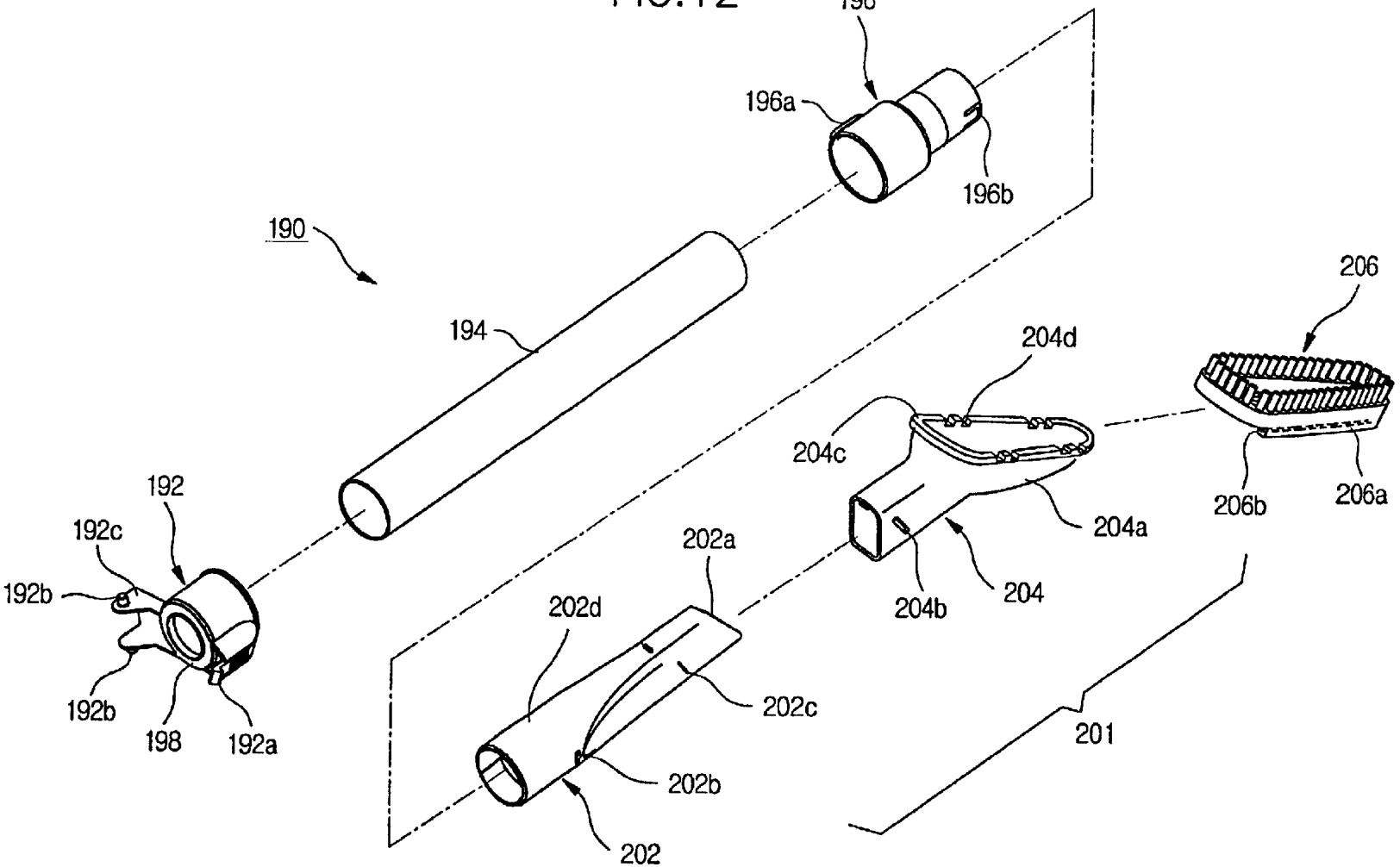
FIG. 12 is an exploded perspective view showing the second cleaner of the vacuum cleaner of FIG. 1.
Figure 13:
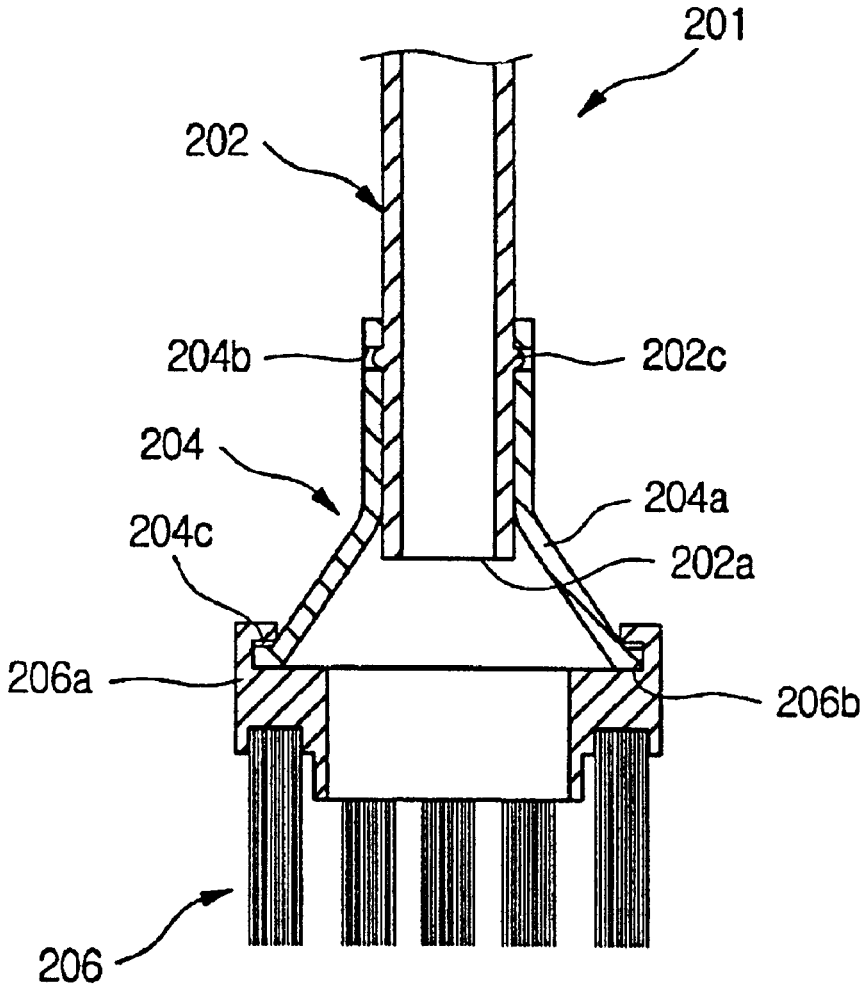
FIG. 13 is a vertical sectional view showing a suction pipe of the second cleaner shown in FIG. 12.

FIG. 12 is an exploded perspective view showing the second cleaner of the vacuum cleaner according to an embodiment of the present invention, and FIG. 13 is a vertical sectional view showing a suction pipe of the second cleaner shown in FIG. 12.

As shown in FIG. 12, the second cleaner 190 is comprised of a second adaptor 192, a hose 194, a joint 196, and a suction pipe 201.

The second adaptor 192 is fixed hingedly into the guide groove 84. The second adaptor 192 has a lock formed integrally at a portion of the outer surface thereof and a arm 192*c* having a hinge shaft 192*b* located at the other portion of the outer surface thereof. The lock 192*a* is fixed to the first locking groove 82*a* of the socket 80, and the hinge shaft 192*b* is inserted into the hinge hole 84*a* of the guide groove 84. A packing 198 is attached to an end of the second adaptor 192 to maintain airtightness between the connecting opening 82 of the socket 80 and the second adaptor 192.

The hose 94 is connected to the other end of the second adaptor 192. Desirably the hose 194 is made of flexible materials which can bend easily.

The joint 196 has a fitting member 196*a* formed at the outer surface thereof to fix the second cleaner 190 to the main body 10. The fitting member 196*a* is fastened detachably to a clip 200 (shown in FIGS. 2 and 21) which is located at the side portion of the outer surface of the second body 14. A first connecting projection 196*b* is formed at a portion of the outer surface of the joint 196.

The clip 200 is attached to a portion of the exhaust duct 120 by locking means such as screws 200*a*. When the fitting member 196*a* is fastened to the clip 200, the second cleaner 190 adheres closely to the main body 10, while the hose 94 is straight. That is, the second cleaner 190 adheres closely to the concave portion 14*a* formed at the outer surface of the second body 14.

As shown in FIG. 13, the suction pipe 201 is comprised of a sharpening suction pipe 202, a divergent suction pipe 204, and a second brush 206.

The sharpening suction pipe 202 has a circular portion 202*d* having a first connecting groove 202*b* and a sharpening portion 202*a* having a second connecting projection. The section of the sharpening portion 202*a* is shaped substantially like a square and narrows gradually. The divergent suction pipe 204 has a second connecting groove 204*b* at a portion thereof and a square head portion 204*a* formed at the other portion thereof. The section of the square head portion 204*a* is shaped substantially like a square and broadens gradually. Flange portions 204*c* having a plurality of cut-off portions 204*d* symmetrically protrude outward at the edge portion of the square head portion 204*a*. The second brush 206 has a brush body portion 206*a* which can be connected separably to the square head portion 204*a*. A guide portion

206*b* which is bent symmetrically is formed at the upper portion of the brush body portion 206*a*.

The sharpening suction pipe 202 is connected to the joint 196 by means of inserting the first connecting projection 196*b* into first connecting groove 202*b*. The divergent suction pipe 204 is connected to the sharpening suction pipe 202 by means of inserting the second connecting projection 202*c* into the second connecting groove 204*b*. The second brush 206 is fitted separably into the divergent suction pipe 204 by fitting the flange portion 204*c* into the guide portion 206*b*. There is the cut-off portion 204*d* of the flange portion 204*c*, so that the friction area of the flange portion 204*c* and the cut-off portion 204*c* decreases when the second brush 206 is either fitted into or pulled out from the divergent suction pipe 204. Thus, the cut-off portion 204*d* allows the second brush 206 to be more easily fitted into or pulled out from the divergent suction pipe 204.

The sharpening suction pipe 202 is used for cleaning the corners of the floor and similar space. The divergent suction pipe 204 is used for cleaning a table and similar surfaces.

The motor assembly 110 is installed firmly in the driving chamber 28 of the main body 10.

Figure 14:
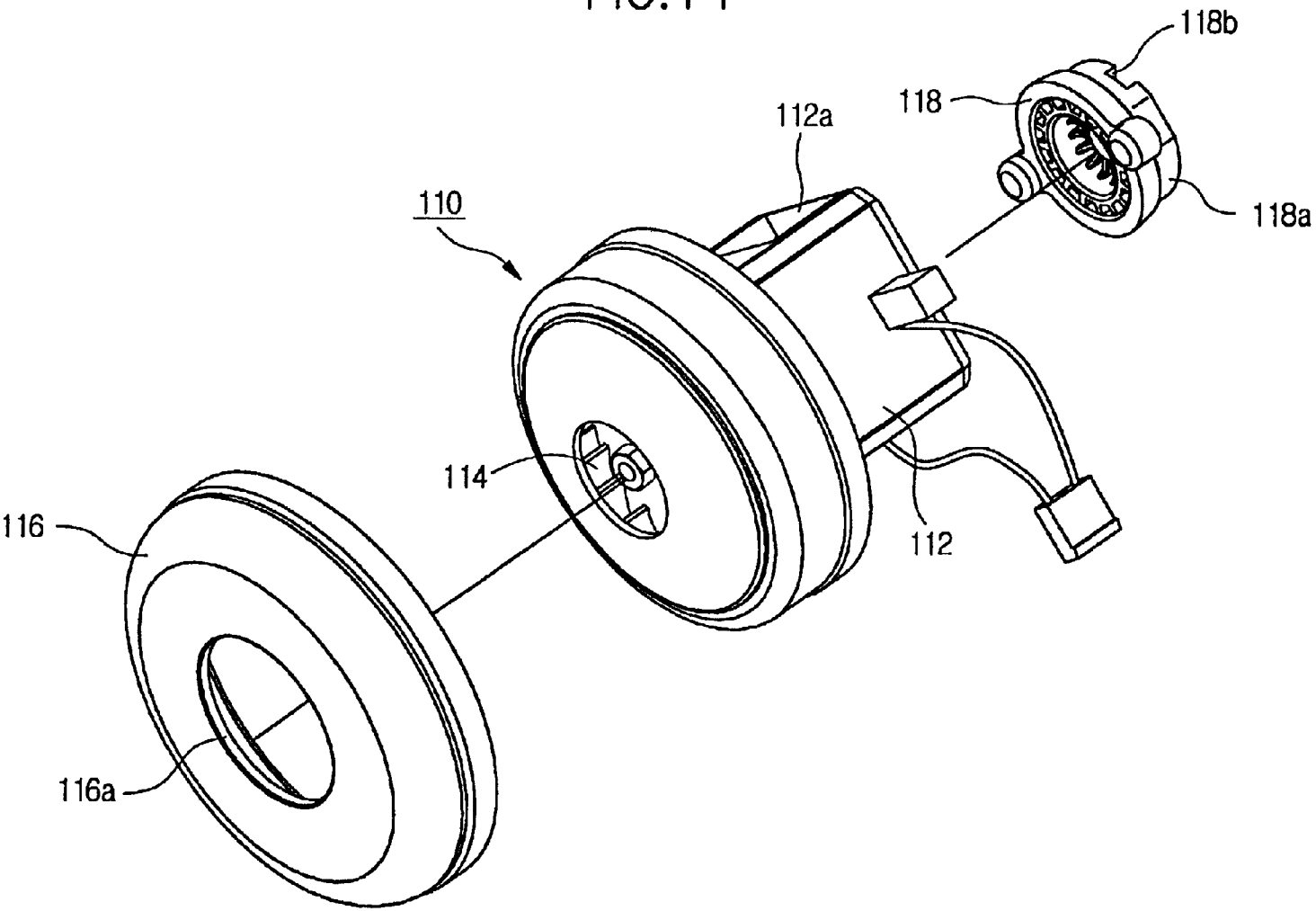
FIG. 14 is an exploded perspective view showing a motor assembly of the vacuum cleaner of FIG. 1.

As shown in FIG. 14, the motor assembly 110 is comprised of a motor 112, an impeller 114 which generates a suction force by operation of the motor 112, a front cap 116 which is installed at the front side of the motor 112, and a rear cap 118 which is installed at the rear side of the motor 112. The front cap 116 has a center hole 116*a* located at the center portion thereof. The rear cap 118 has planes 118*a* provided at both of the outer portion thereof, and an engaging groove 118*b* provided vertically at the rear side thereof. Desirably the front cap 116 and the rear cap 118 are made of flexible materials to absorb the vibration generated by the operation of the motor 112.

Figure 15:
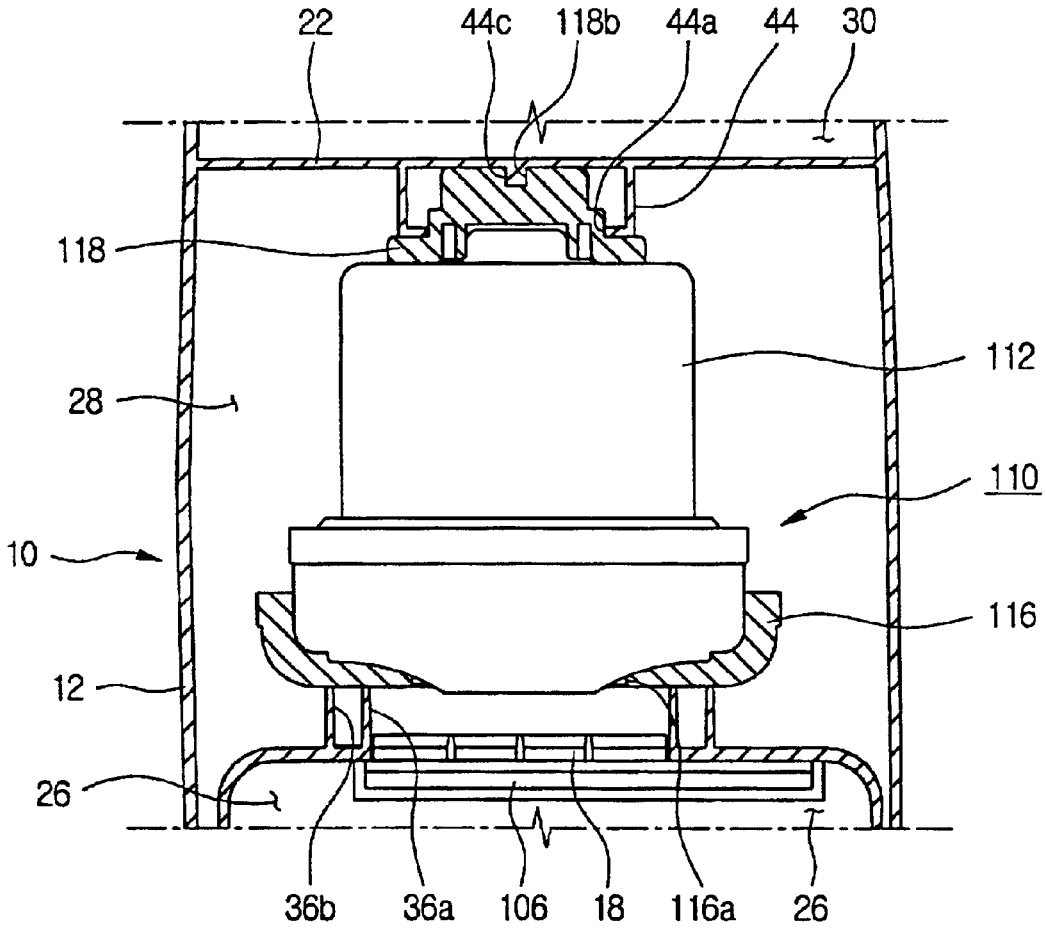
FIG. 15 is a plan view showing the motor assembly shown in FIG. 14 installed in a driving chamber of the main body.

As shown in FIG. 15, the protrusion pipes 36*a* and 36*b* of the grill partition 18 support the front cap 116 and the first supporting portion 44*a* of the first supporting block 44, and the first supporting portion 46*a* of the first supporting block 46 supports the rear cap 118. The plane 118*a* comes in contact with the first straight line portion 44*b* of the first supporting block 44 and the second straight line portion 46*b* of the second supporting block 46. The engaging groove 118*b* is fitted to the first supporting protrusion 44*c* of the first supporting block 44 and the second supporting protrusion 46*c* of the second supporting block 46. Therefore, the motor assembly 110 is fixed firmly to the driving chamber 28.

The cord reel 260 is installed firmly in the cord reel chamber 30 by means of the third supporting ribs 48 and the fourth supporting ribs 50.

Figure 16:
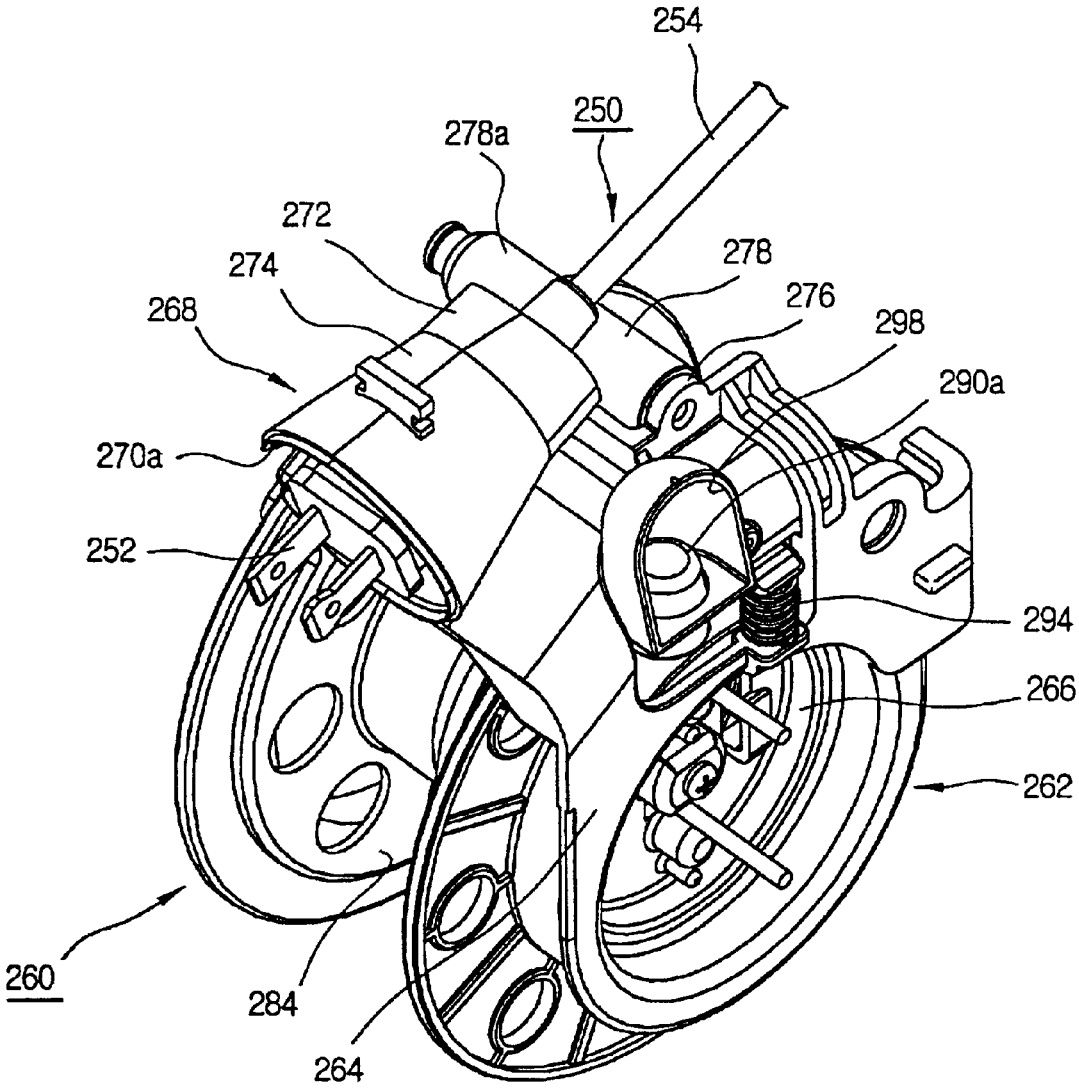
FIG. 16 is a perspective view showing a cord reel of the vacuum cleaner of FIG. 1.
Figure 17:
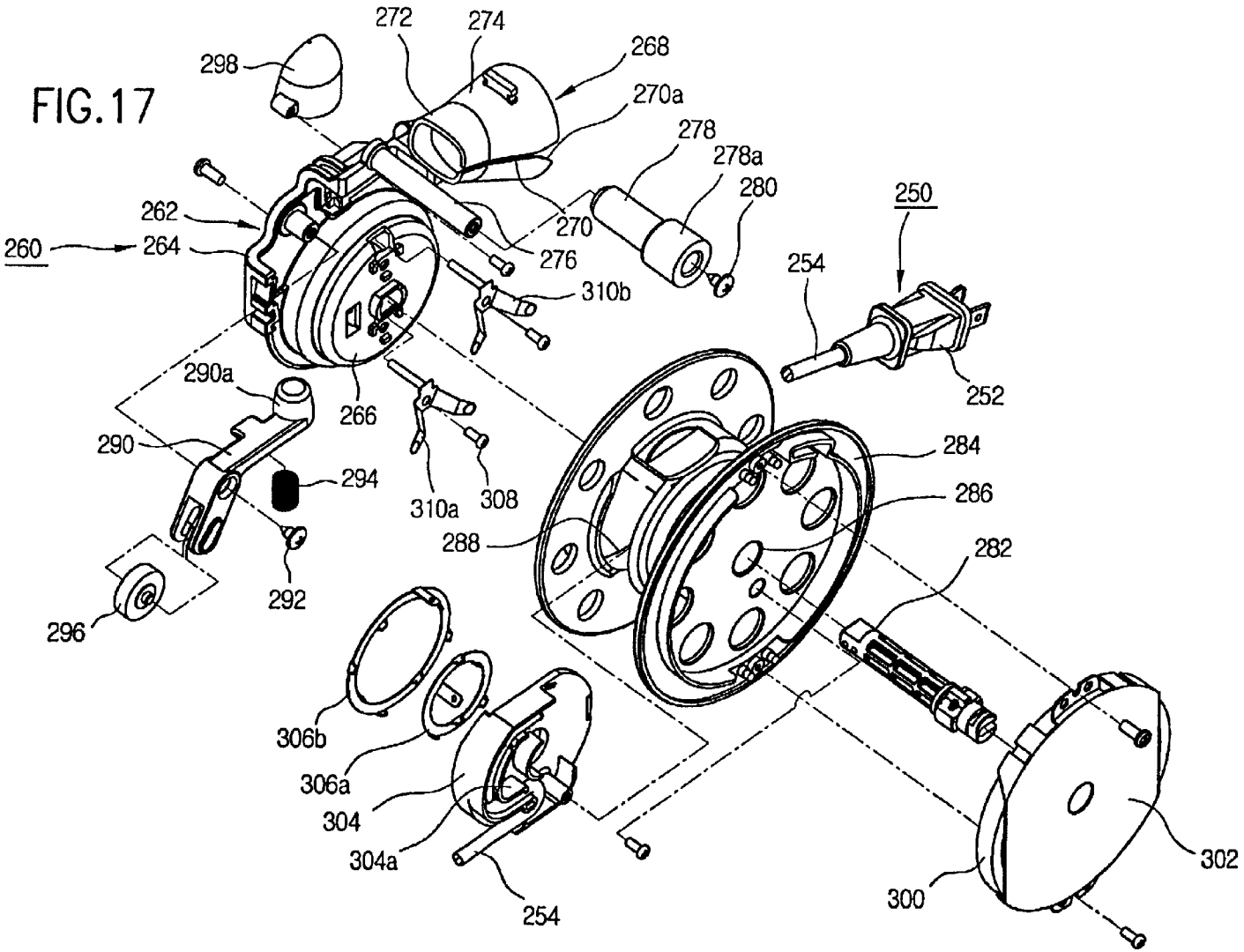
FIG. 17 is an exploded perspective view showing the cord reel shown in FIG. 16.

As shown in FIGS. 16 and 17, the cord reel 260 is comprised of a mounting bracket 262, a guide roller 278, and a bobbin 284.

The mounting bracket 262 has a base plate 264 which is installed firmly in the cord reel chamber 30 by the third ribs 48 and the fourth ribs 50, a hub 266 which protrudes from a side of the base plate 264, and a hollow cord outlet 268 which is formed integrally with the base plate 264 for accommodating the power cord 250. A central shaft 282 which is inserted into a shaft hole 286 of the bobbin 284 is installed at the center portion of the hub 266. The cord outlet 268 accommodates the power cord 250 which passes on power to the motor 112. The power cord 250 comprises a plug 252 connected to sources of electricity and a cord 254 connected to the plug 252.

The cord outlet 268 has a torn portion 270 at a portion thereof for inserting the cord 254 therein. A guide portion 270*a* which broadens gradually is provided at the inlet portion of the torn portion 270 to insert easily the cord 254 into the cord outlet 268. It is desirable that the width of the torn portion 270 is slightly shorter than the diameter of the cord 254. The torn portion 270 returns to its usual shape as soon as the cord 254 is inserted into the cord outlet 268, so it prevents the cord 254 from eacaping from the cord outlet 268. Also, the cord outlet 268 has a square portion 272 restricting the movement of the cord 254 and a divergent portion 274 of which the diameter becomes longer gradually. The divergent portion 274 is fixed to the cord inlet 66 of the second body 14.

The guide roller 278 is fixed rotatably to a fixing shaft 276, which is fixed firmly between the cord outlet 268 and the hub 266, to guide the cord 254 smoothly. An annular guide flange 278*a* is formed at an end portion of the guide roller 278 to prevent the cord 254 from escaping from the guide roller 278. The guide roller 278 decreases the load provided to the fixing shaft 276.

The bobbin 284 winding up the cord 254 is fixed rotatably to the hub 266. The bobbin 284 has a brake drum 288 provided at the center portion thereof. The brake drum 288 brakes by a brake lever 290 which is urged in the direction of braking the brake drum 288 by means of elastic means such as a spring 294. The brake lever 290 has a roller 296, which presses an outer surface of the brake drum 288, fixed rotatably to an end thereof and an operating button 290*a* attached to the other end thereof. The operating button 290*a* is exposed toward the outer surface of the main body 10 and covered by a cap 298. The cap 298 prevents dust from entering into the cord reel chamber 30 of the main body 10. A side of the bobbin 284 is covered with a side cover 302 having a spiral spring 300 embedded therein. The spiral spring 300 imparts a turning effect to the bobbin 284 in the direction of winding up when a user releases the brake lever 290 that has been holding the brake drum 288. That is to say, if the user presses the operating button 290*a* of the break lever 290, the roller 296 is set apart from the brake drum 288, and then the bobbin 284 rotates about the central shaft 282 by the elasticity of the spiral spring 300. Thus, the bobbin 284 winds up the cord 254.

A cord clamper 304 is embedded in the center portion of the bobbin 284. The cord clamper 304 has a clamping portion 304*a* which clamps firmly the cord 254. A pair of ring terminals 306*a* and 306*b* connected to the cord 254 are attached to the side surface of the cord clamper 304. Also, the ring terminals 306*a* and 306*b* are attached to the side surface of the hub 266 by screws and come in contact with a pair of plate terminals 310*a* and 310*b*.

The handle 210 is fixed hingedly at the upper end of the main body 10 in a retractable manner.

Figure 18:
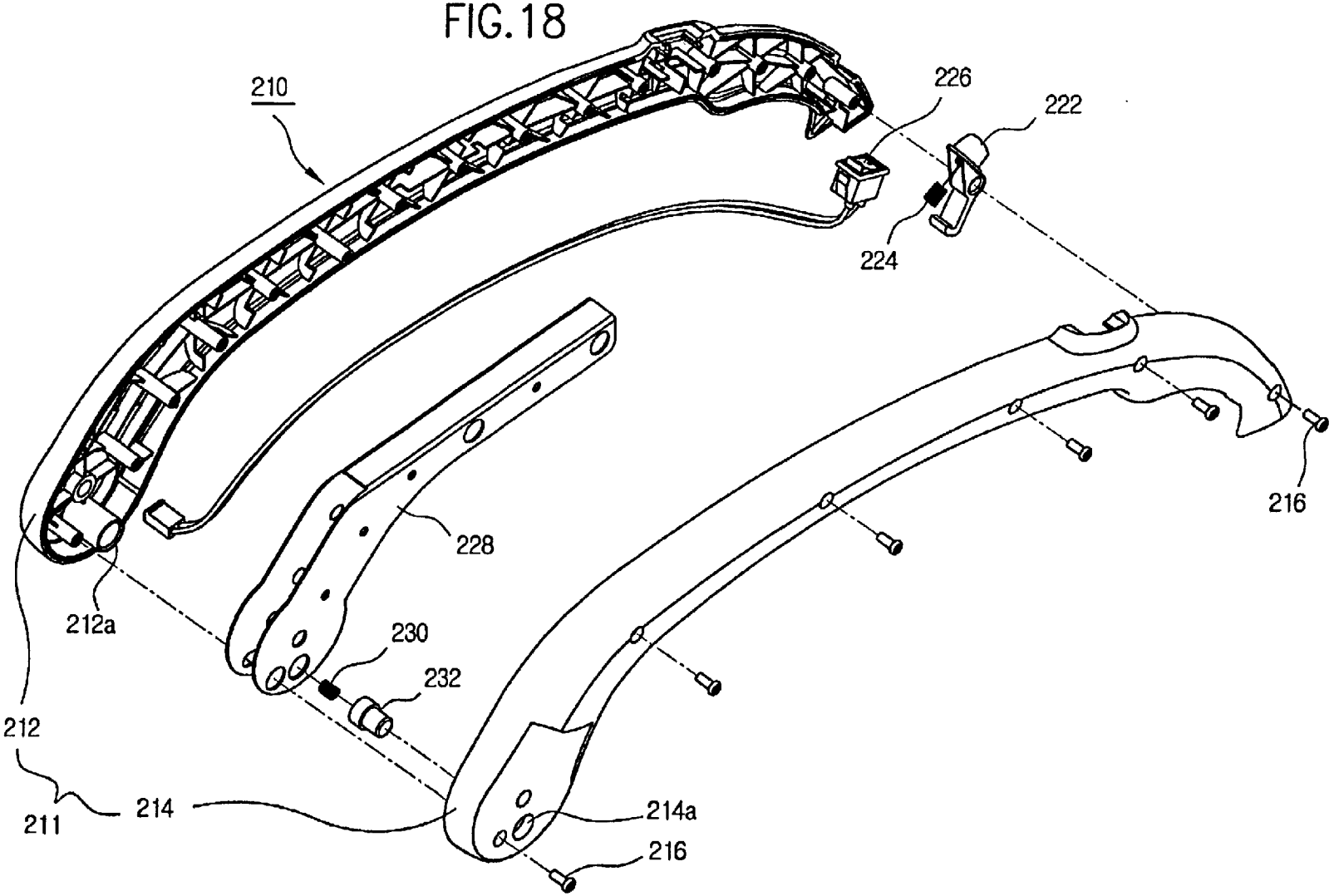
FIG. 18 is an exploded perspective view showing a handle of the vacuum cleaner of FIG. 1.
Figure 19:
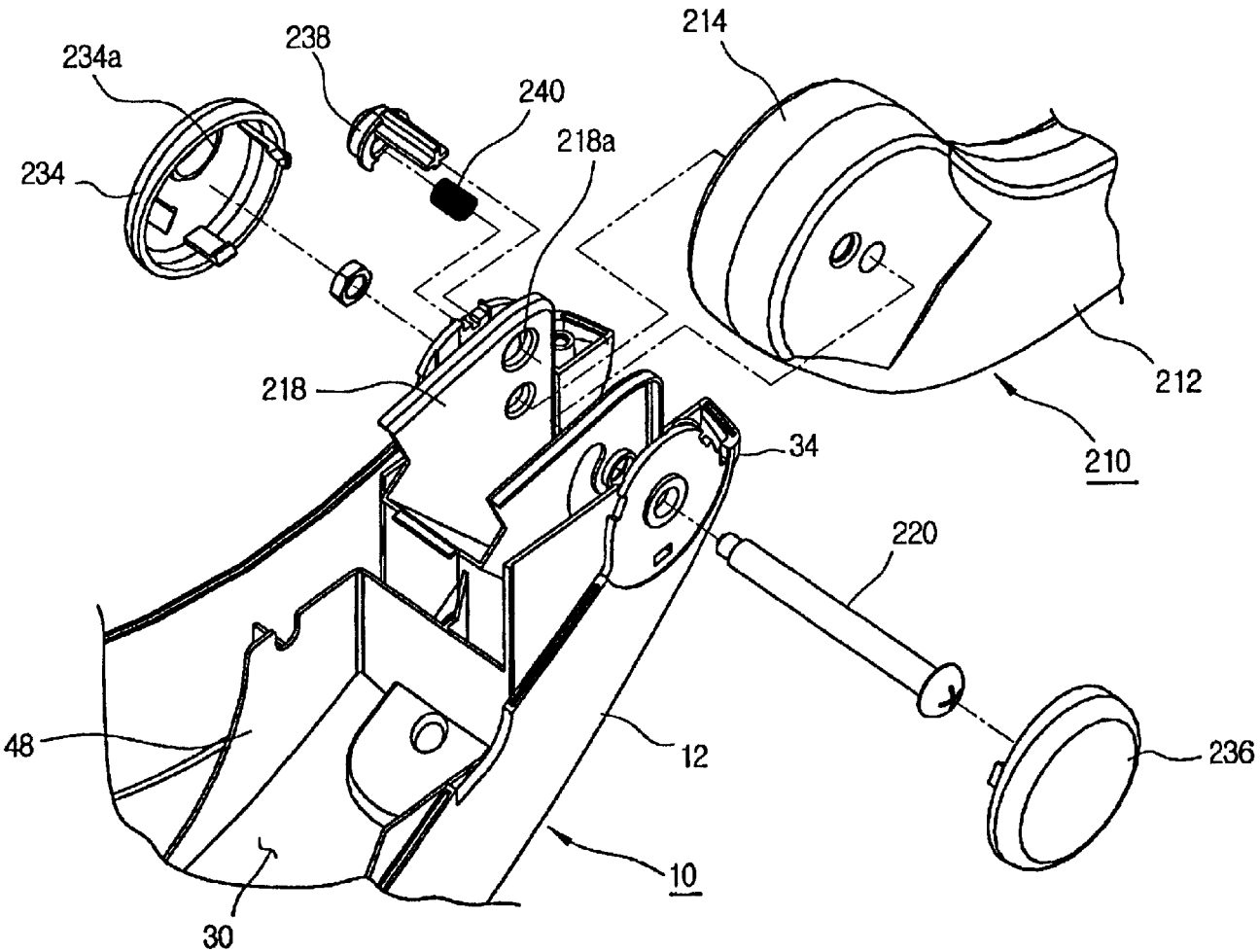
FIG. 19 is an exploded perspective view showing the handle shown in FIG. 19 connected to the main body.

As shown in FIGS. 18 and 19, the handle 210 is comprised of a stick handle 211, a bracket 218, a handle locking button 222, and a handle stopper 232.

The stick handle 211 comprises a first stick 212 and a second stick 214. The first stick 212 and the second stick 214 are assembled by locking means such as screws 216. A boss 212*a* is formed at the lower end of the inner surface of the first stick 212. A hole 214*a* is provided at the lower end of the inner surface of the second stick 214. A handle stopper 232 which can appear or disappear through the hole 214*a* is mounted on the boss 212*a*. The handle stopper 232 is urged by means of a spring 230.

The stick handle 211 has a handle locking button 222, which is fixed to the handle locking protrusion 68*a* of the second body 14, at the other end thereof. The handle 210 has a power switch 226 electrically connected to a terminal box 330 (shown is FIG. 25) and installed at the upper portion thereof. A reinforcing plate 228 is inserted between the first stick 212 and the second stick 214 to increase strength of the handle 210.

The bracket 218 having a pin hole 218*a* is fixed firmly to the fork end 34 of the main body 10. An end of the stick handle 211 is connected hingedly to the bracket 218 by means of a pin 220. If the handle stopper 232 is inserted into the pin hole 218*a* of the bracket 218, the stick handle 211 gets unfolded firmly along the longitudinal direction of the main body 10.

A first side cap 234 and a second side cap 236 are attached to both sides of the fork end 34 respectively to cover the pin 220. A release button 238 is provided at the first side cap 234 to control the handle stopper 232. The release button 238 is urged toward the outer side of the first side cap 234. If a user presses the release button 238, the handle stopper 232 escapes from the pin hole 218*a*. Thus, the stick handle 211 can swing vertically.

The exhaust duct 120 is mounted on the driving chamber 28 of the main body 10 to exhaust air from the driving chamber 28 to the exhaust grill 62.

Figure 20:
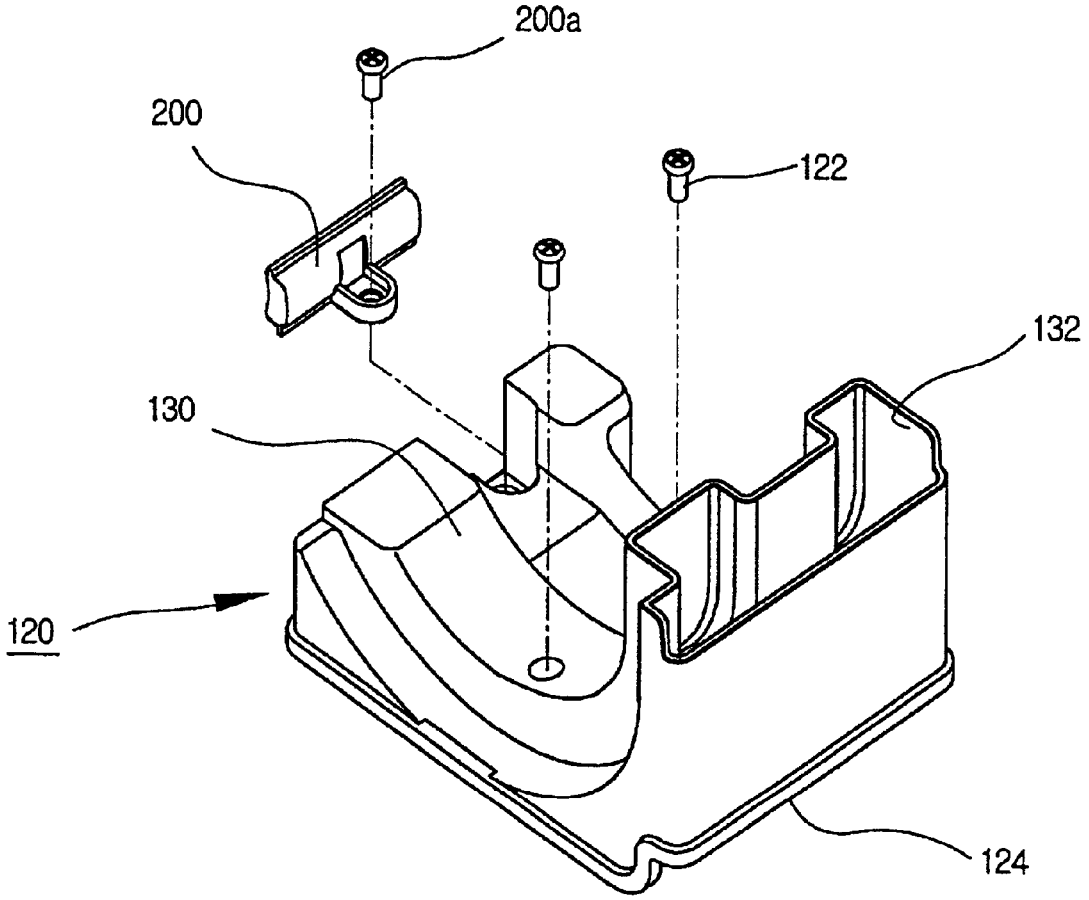
FIG. 20 is a perspective view showing an exhaust duct of the vacuum cleaner of FIG. 1.
Figure 21:
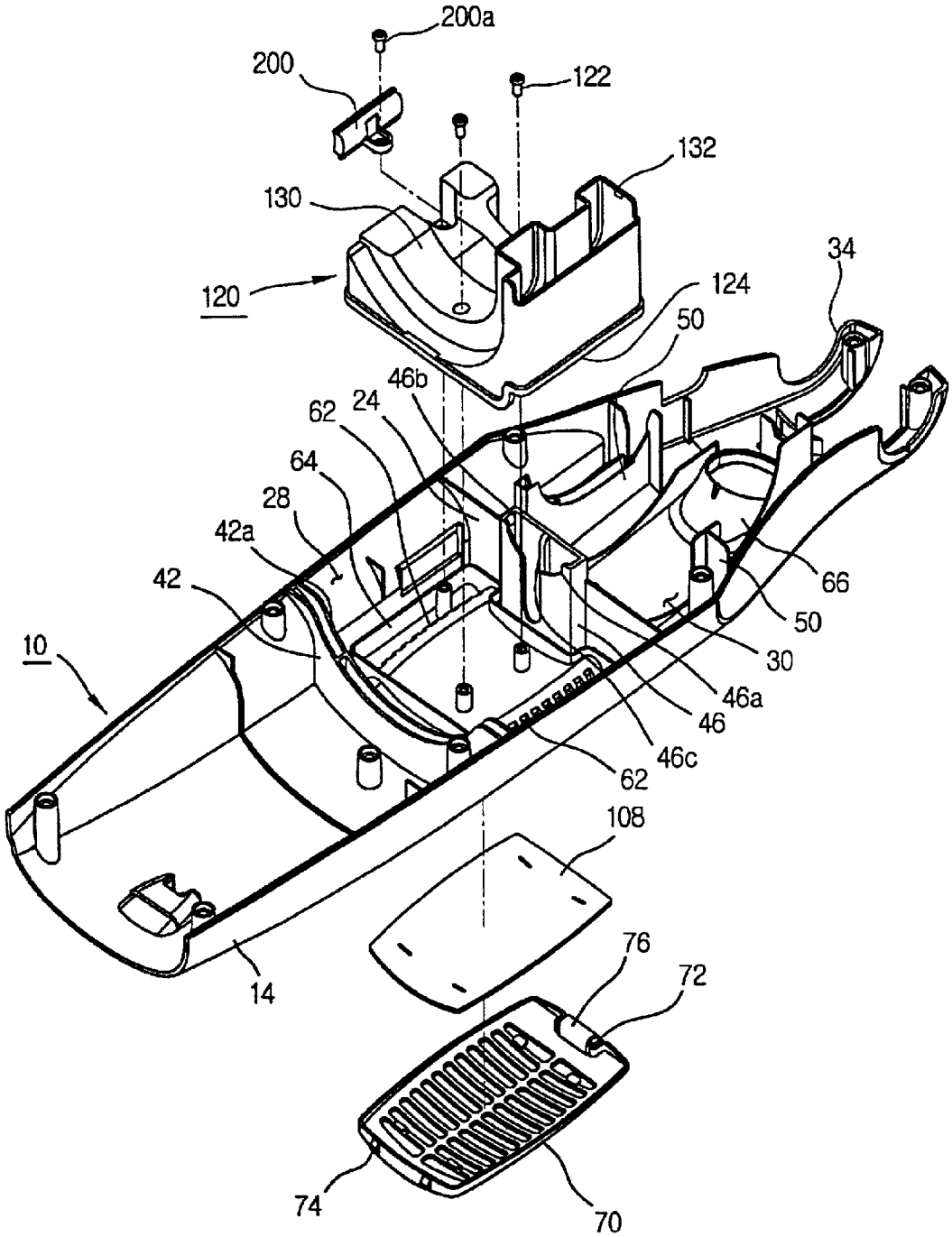
FIG. 21 is a perspective view showing the exhaust duct shown in FIG. 20 installed in the main body.

As shown in FIGS. 20 and 21, the exhaust duct 120 has an inlet 132, a curved portion 130, and an outlet 124.

Air in the driving chamber 28 is sucked into the exhaust duct 120 through the inlet 132. The curved portion 130 extends from the inlet 132 and surrounds a portion of the motor assembly 110 at a predetermined set distance. The curved portion 130 cuts off the exhaust grill 62 from the motor assembly 110 to decrease the noise generated by the operation of the motor 112. The outlet 124 extends from the curved portion 130 and is connected to the exhaust grill 62. A framework 136 having a coupling groove 138 is formed at the end portion of the outlet 124. The coupling rib 64 of the second body 14 is coupled with the coupling groove 138 to maintain airtightness between the exhaust duct 120 and the second body 14.

Figure 22:
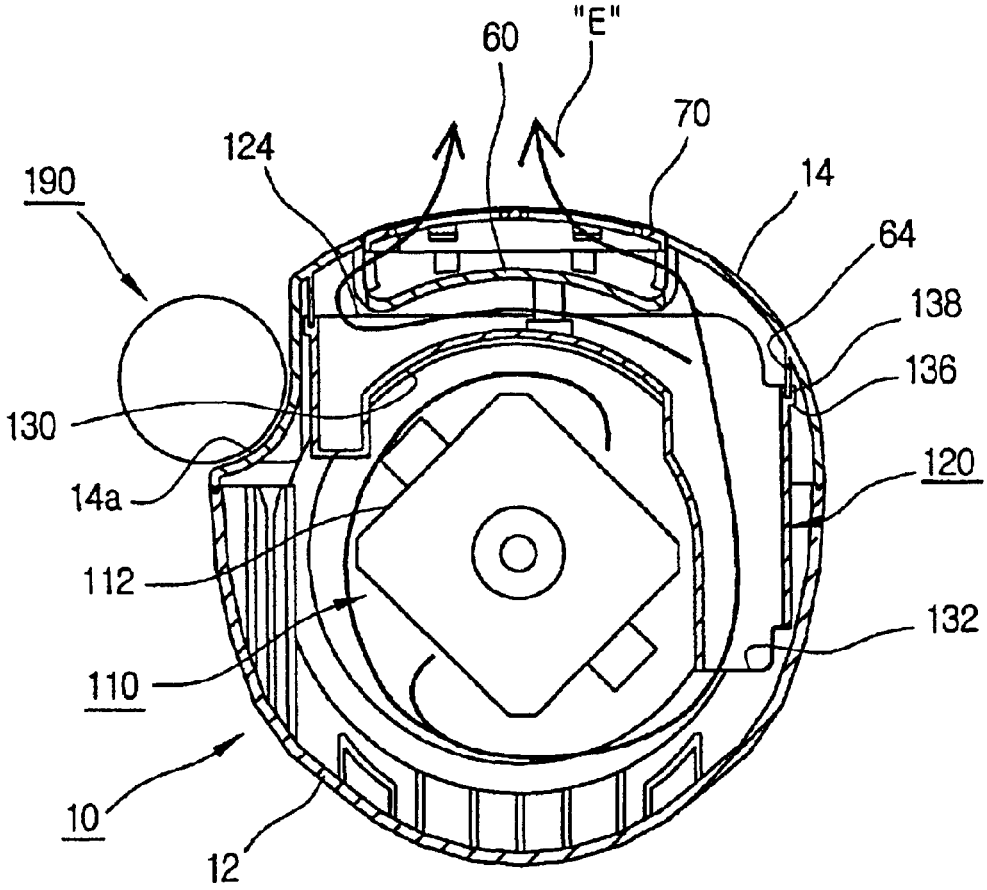
FIG. 22 is a perspective view of the main body showing air flow generated inside of the driving chamber by the exhaust duct.

As shown in FIG. 22, air, which is sucked into the driving chamber 28 by the operation of the motor 112, is exhausted outward along the direction of "E". That is, air is sucked through the inlet 132, the curved portion 130, and the outlet 124, and it is then exhausted through the exhaust grill 62. Air passed through the exhaust grill 62 is finally filtered while passing through the second filter 108, and it is then exhausted through the grill cover 70. At this time, the exhaust grill 120 decreases noise generated by operation of the motor 112 or flow of air, because it cuts off the exhaust grill 62 from the motor assembly 120. Furthermore, the noise decreases by fluid friction in the curved portion 130 and at the depressed area 60.

Figure 23:
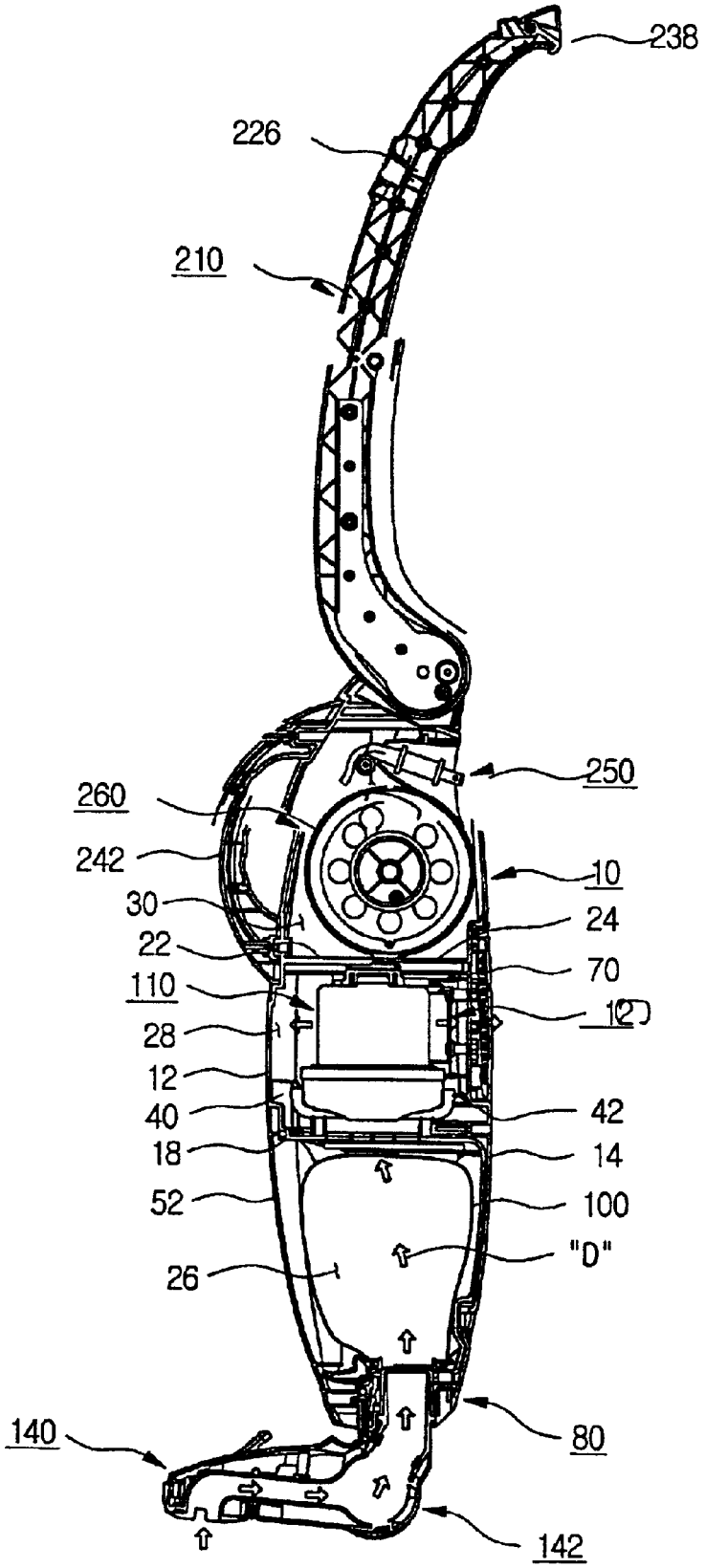
FIG. 23 is a vertical sectional view of the vacuum cleaner showing air flow generated inside of the main body.

As shown in FIG. 23, when the first cleaner 140 is used, the sucked air containing dust moves along the direction of "D". That is, air containing dust is sucked into the suction port 144*a*, and it then moves to the dust bag 100 clamped in the dust collecting chamber 26 through the connecting opening 82 of the socket 80. While the air containing dust passes through the dust bag 100 and the first filter 106, the dust is collected in the dust collecting chamber 26. Then, the filtered air moves to the driving chamber 28 through the grill partition 18 and the driving chamber 28, and is exhausted outward through the exhaust duct 120 as decribed above.

As shown in FIG. 1, an auxiliary handle 242 is fixed on the upper portion of the outer surface of the main body 10. It is desirable that the auxiliary handle 242 is shaped like an arc and fixed firmly to the main body 10. The auxiliary handle 242 is used for lifting and moving the main body 10.

The shoulder belt 320 is fixed movably to the main body 10.

Figure 24A:
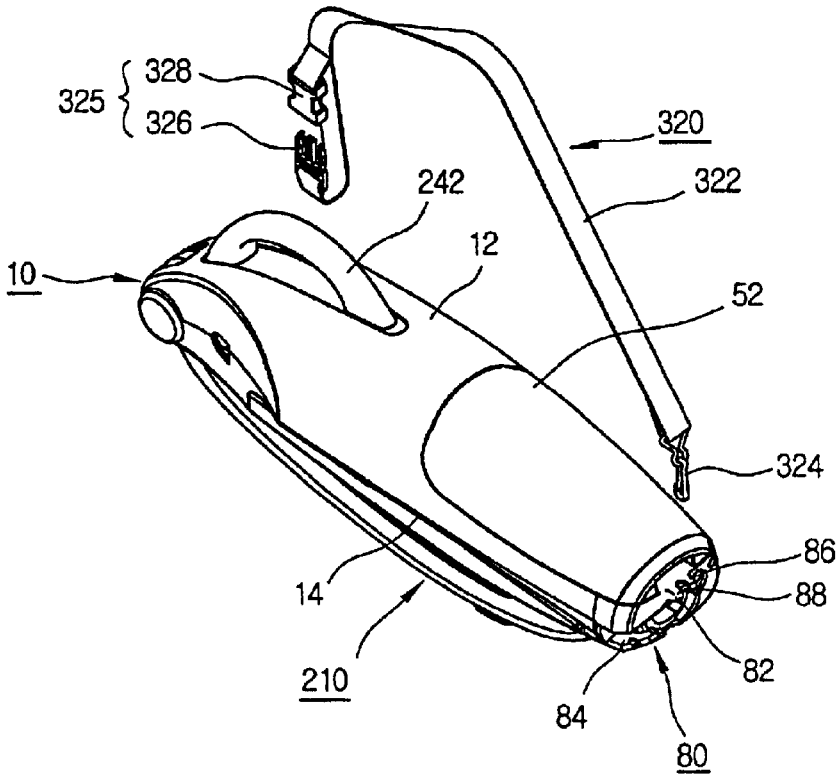
FIGS. 24*a* and 24*b* are perspective views showing a shoulder belt of the vacuum cleaner of FIG. 1.
Figure 24B:
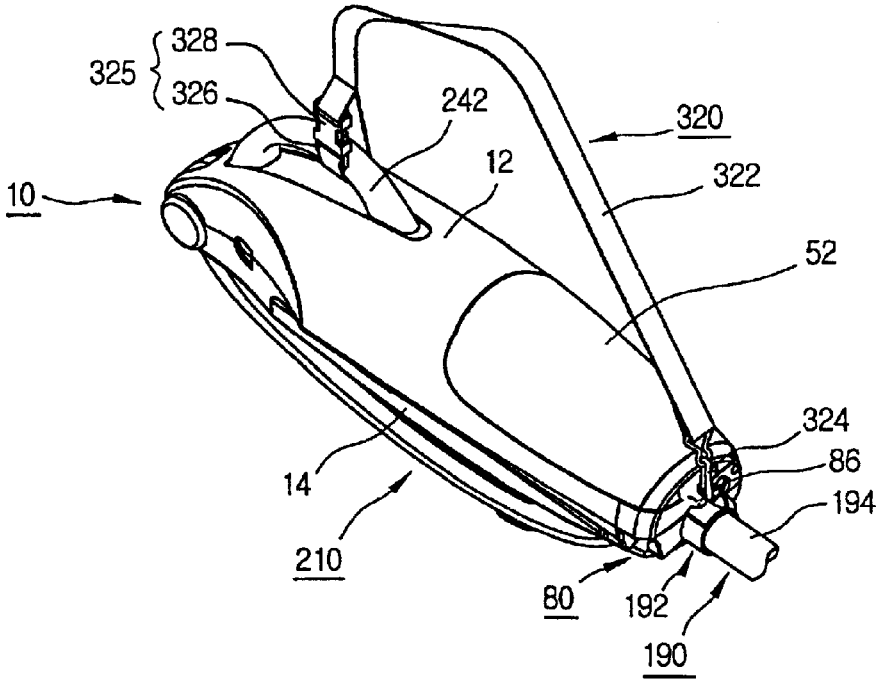

As shown in FIGS. 24*a* and 24*b*, the shoulder belt 320 is comprised of a belt 322, a hook 324, and a buckle 325.

The long belt 322 is made of flexible materials. The hook 324 is connected to an end of the belt 322 and is fixed to the belt pin 88 of the positioning protrusion 86 in order to be loose. The buckle comprises a first buckling part 326 and a second buckling part 328 and is fixed to the auxiliary handle 242. The shoulder belt 320 can further comprise means for adjusting a length of the shoulder belt 320.

Hereinafter, a wiring condition of the vacuum cleaner according to an embodiment of the present invention will be described.

Figure 25:
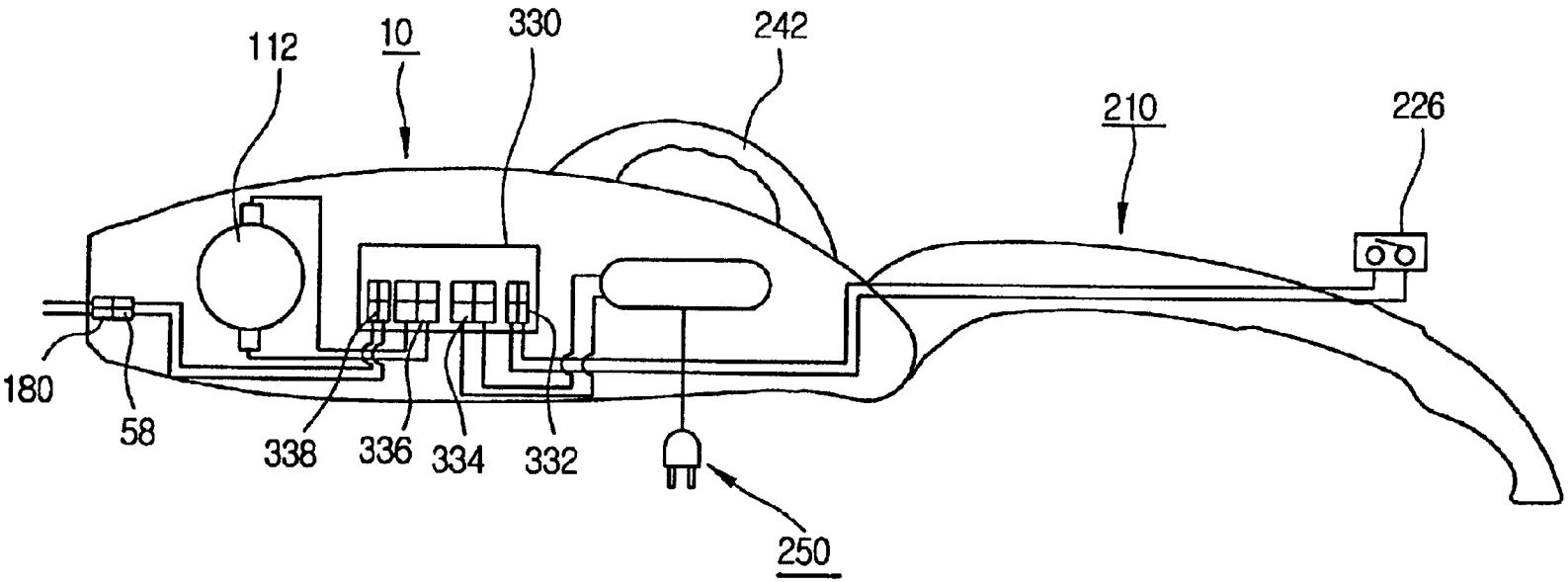
FIG. 25 is a wiring diagram showing a vacuum cleaner of FIG. 1.

As shown in FIG. 25, the terminal box 330 provided in the main body 10 is comprised of a first terminal 332, a second terminal 334, a third terminal 336, and a fourth terminal 338. The first terminal 332 is connected electrically to the ring terminals 306*a* and 306*b* connected electrically to the cord 254. The second terminal 334 is connected electrically to the motor 112. The third terminal 336 is connected electrically to the power switch 226. The fourth terminal 338 is connected electrically to the terminal 58 of the socket 80. When the electrically operated brush head is used, the connector 180 is connected electrically to the terminal 58.

Hereinafter, how to use and to move the vacuum cleaner according to an embodiment of the present invention will be described.

Figure 26:
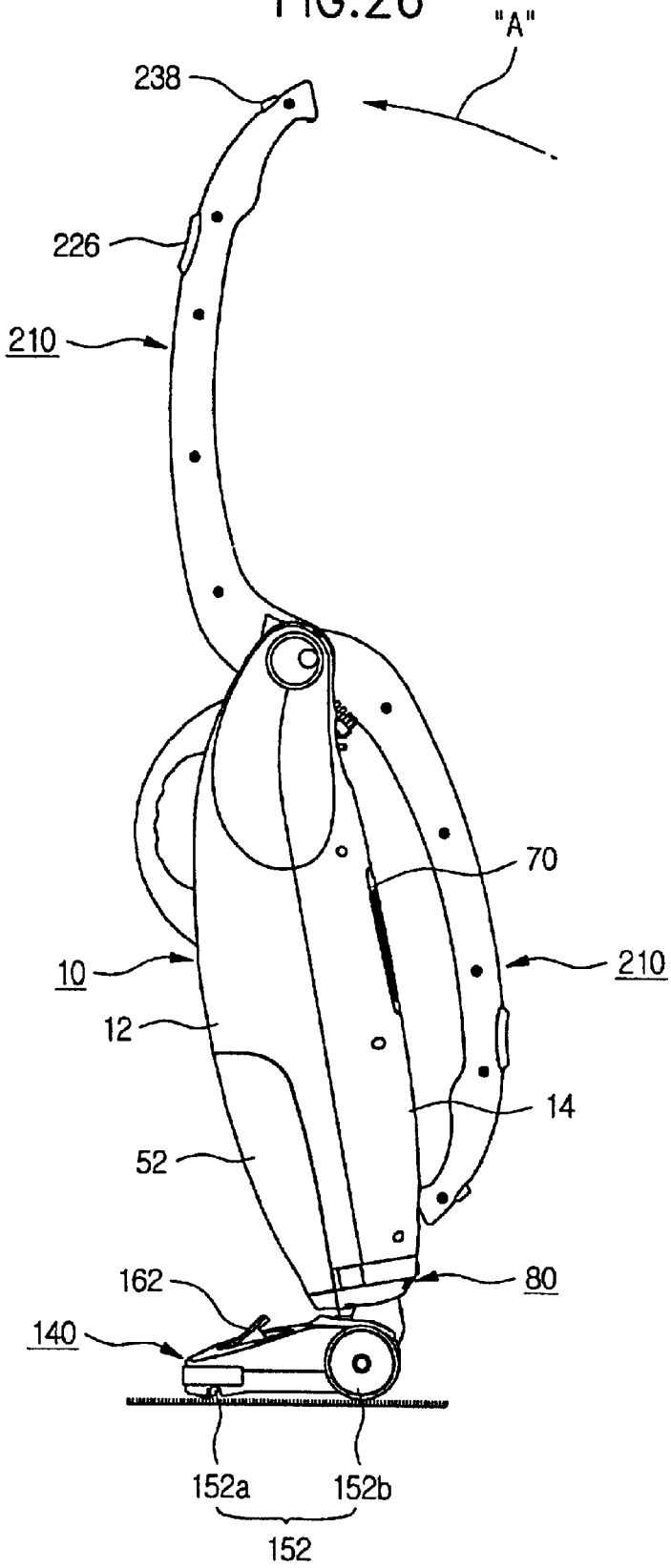
FIG. 26 is a side view showing the vacuum cleaner in the upright position.

FIG. 26 is a side view showing the vacuum cleaner in the upright position.

As shown in FIG. 26, when the vacuum cleaner is not used, it can stand stably in the upright position, because the positioning protrusion 86 of the socket 80 is supported by the positioning portion 146*b* of the brush head 142 in proper angle. The handle 210 is fixed to the second body 14.

Hereinafter, how to use the first cleaner 140 will be described.

As shown in FIG. 26, if a user rotates the handle 210 along the direction of "A", it is in an extended position along the longitudinal direction of the main body 10. As shown in FIG. 19, in the extended position, the end portion of the handle stopper 232 is inserted into the pin hole 218*a* of the bracket 218 by biasing of the spring 230, so that the handle 210 is fixed in the extended position.

The cord 254 of the power cord 250 is drawn out from the cord reel 260 and is connected to the power source. Subsequently, if the power switch 226 is turned ON, suction force is generated by the operation of the motor 122. Then, an air flow containing great amount of dust flows through the suction port 144*a*.

Figure 27:
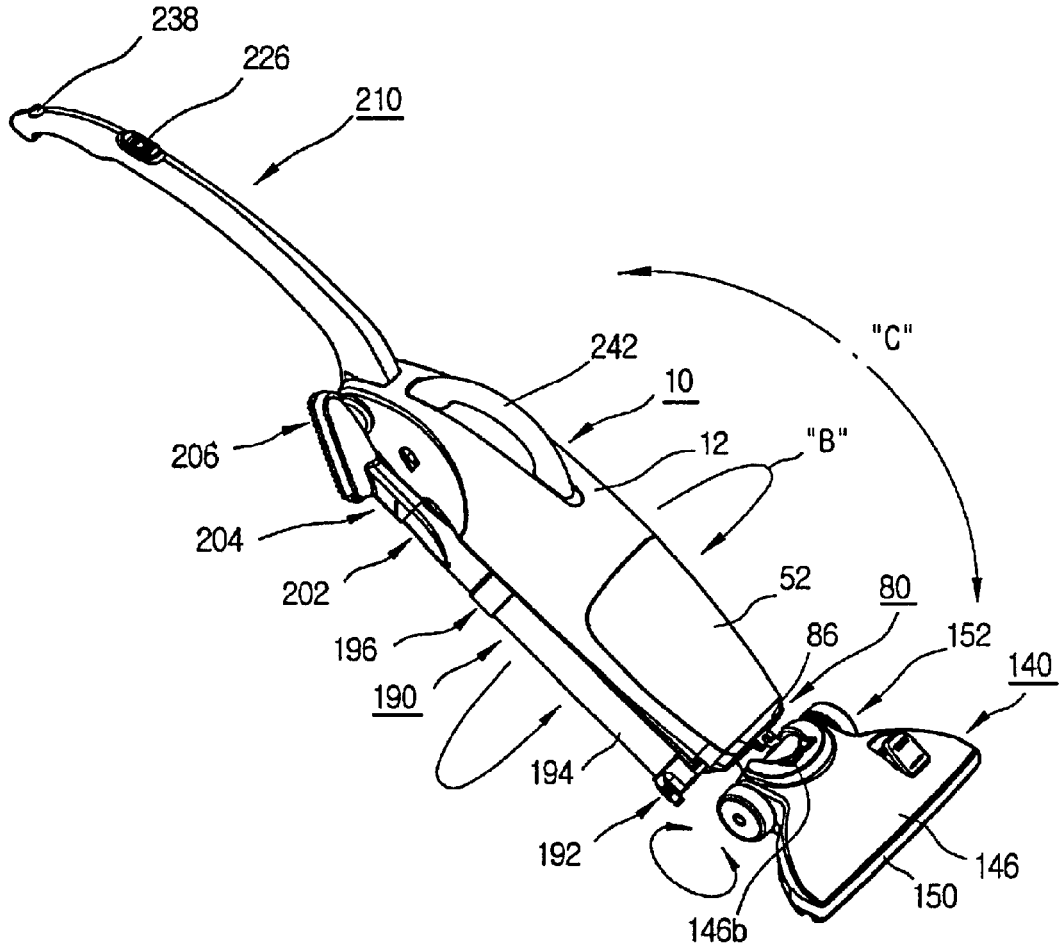
FIG. 27 is a perspective view showing a state of using the first cleaner.

FIG. 27 is a perspective view showing a state of using the first cleaner.

As shown in FIG. 27, when a user moves the main body 10 by holding on to the handle 210, the first cleaner 140 moves quite freely by wheels 152 of the brush head 142. If the user operates the handle 210 in the direction of "B", the second connecting pipe 172*c* of the first adaptor 172 rotates horizontally. Then, if either the first stop rib 174*a* or the second stop rib 174*b* of the first adaptor 172 is blocked by the rotation stopper 170*e* of the rotary duct 170, the direction of the brush head 142 changes in the same direction of the direction of rotation of the handle 210. Meanwhile, if a user turns the handle 210 in the direction of "C", the rotary duct 170 rotates vertically about the shaft 170*b*. Thus, inclination of the main body 10 can be adjusted easily.

Figure 31:
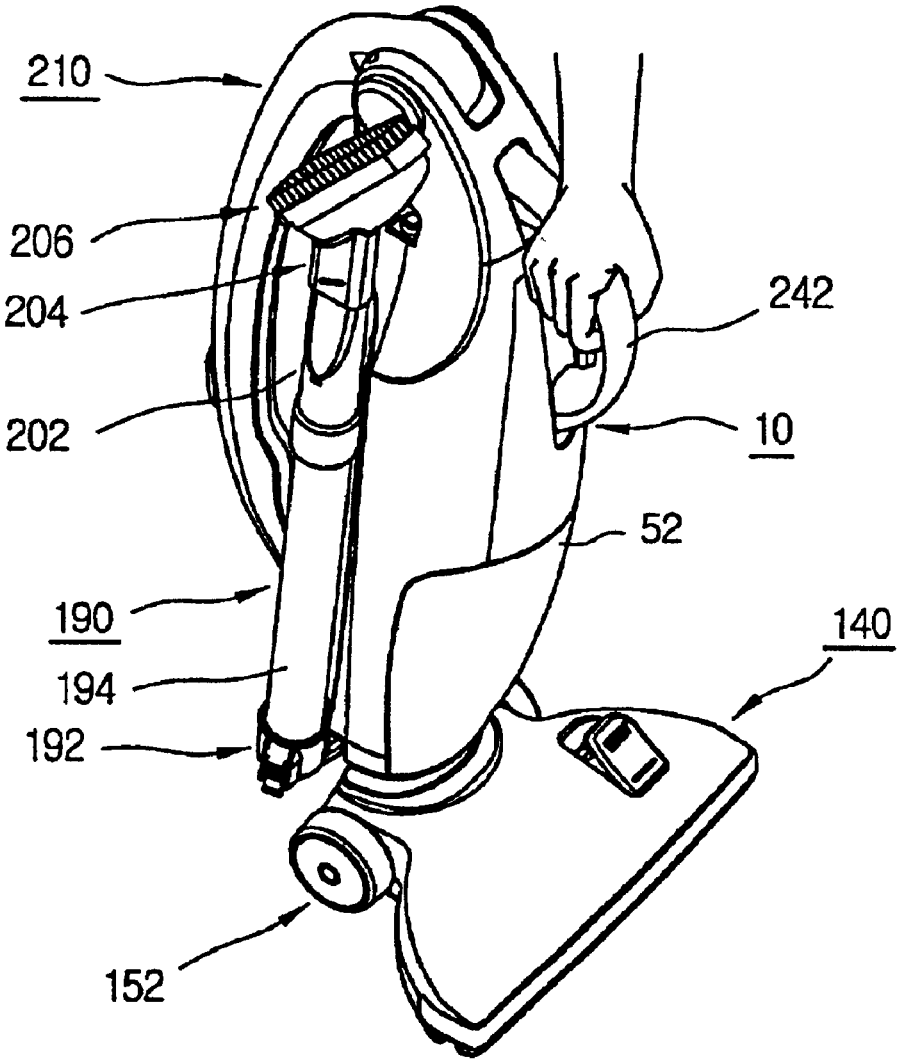
FIG. 31 is a perspective view showing a state of using the first cleaner while lifting the vacuum cleaner by the auxiliary handle.

FIG. 31 is a perspective view showing a state of using the first cleaner while lifting the vacuum cleaner by the auxiliary handle.

As shown in FIG. 31, user can use the vacuum cleaner by holding on to the auxiliary handle 242.

Hereinafter, how to use the second cleaner 190 will be described.

Figure 28:
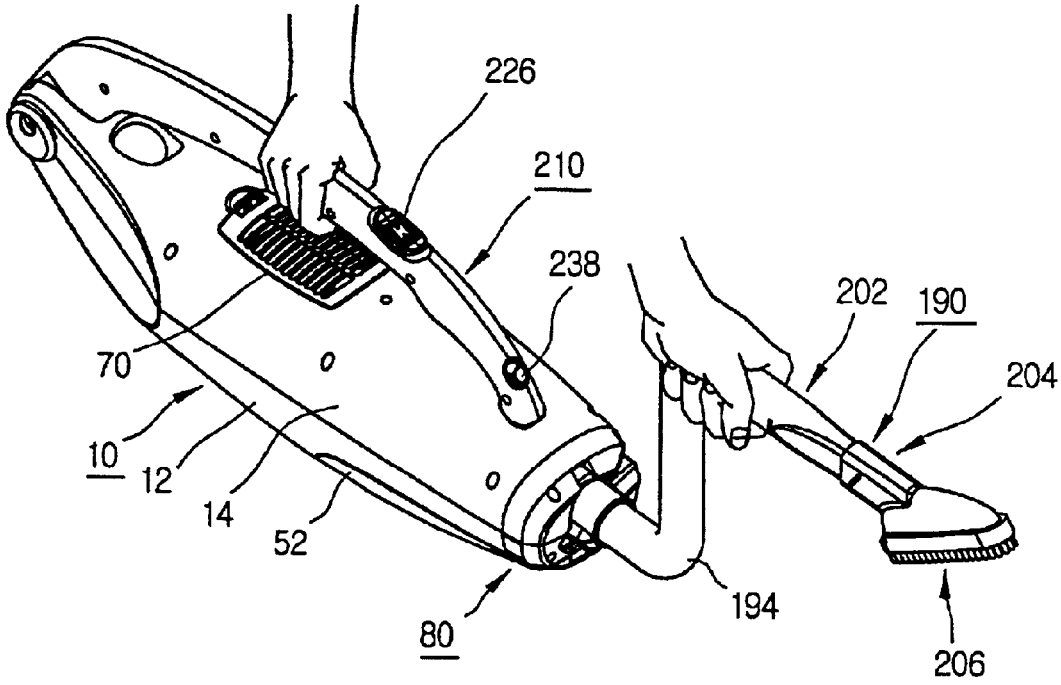
FIG. 28 is a perspective view showing a state of using the second cleaner.

FIG. 28 is a perspective view showing a state of using the second cleaner.

At the time of using the second cleaner 190, a user first separates the first cleaner 140 from the socket 80 by pressing the locking button 94 of the socket 80. Next, the user pulls the second cleaner 190 and the main body 10 apart by unlocking the fitting member 196*a* of the second cleaner 190 from the clip 200. Then, the user connects the second adaptor 192 to the connecting opening 82 of the socket 80 by turning it about the hinge shaft 192*b*. At this time, the lock 192*a* of the second adaptor 192 is fastened to the first locking groove 82*a*, so the second cleaner 190 is connected firmly to the socket 80.

As shown in FIG. 26, if a user rotates the handle 210 in opposite directions of the "A", the handle 210 turns about the pin 220 and is in a retracted position. That is, the handle locking button 222 is fastened to the handle locking protrusion 68*a* of the second body 14, so the handle 210 is fixed to the main body 10. The user can clean with the second cleaner 190 while holding on to the the handle 210.

A user can select either the sharpening suction pipe 202 or the divergent suction pipe 204 according to a cleaning area. The sharpening suction pipe 202 can be effectively used for cleaning the corners of the floor and similar surfaces. Meanwhile, the divergent suction pipe 204 can be effectively used for cleaning a table and similar surfaces. The divergent suction pipe 204 attached to the second brush 206 is useful in cleaning a carpet, a sofa, a bed, etc.

Figure 29:
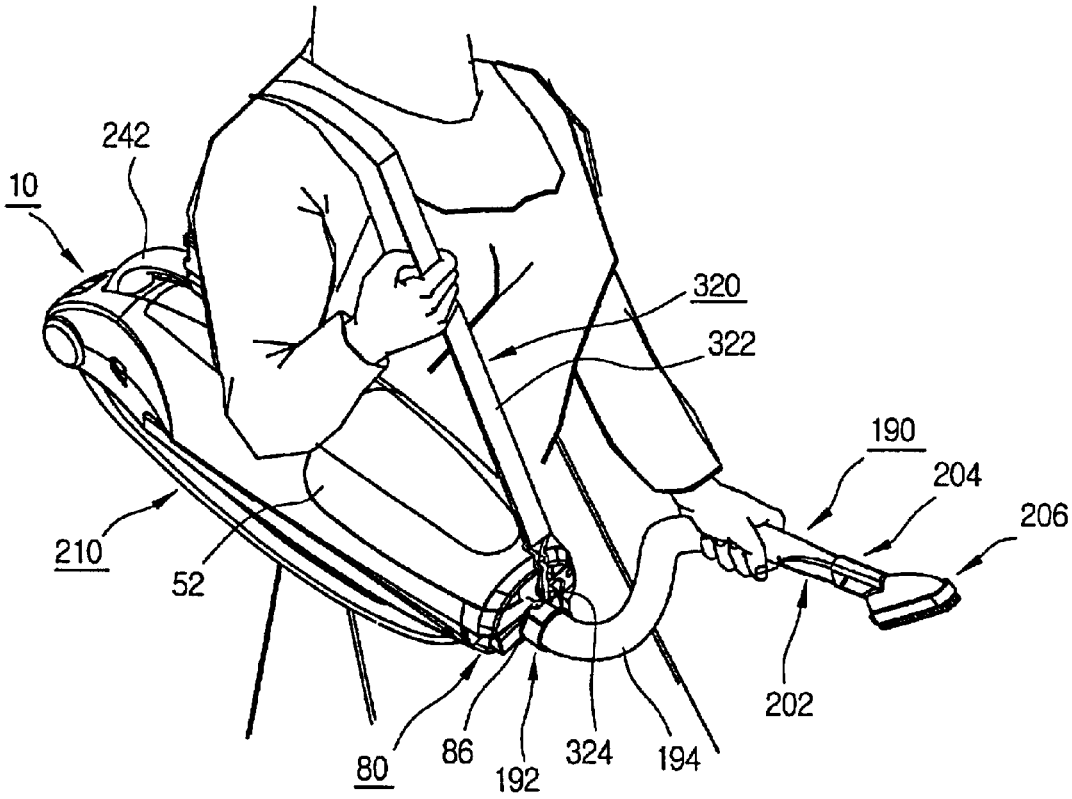
FIG. 29 is a perspective view showing a state of using the second cleaner while lifting the vacuum cleaner.

FIG. 29 is a perspective view showing a state of using the second cleaner while lifting the vacuum cleaner.

As shown in FIG. 29, the second cleaner 190 can be used easily while lifting and moving the vacuum cleaner by the shoulder belt 320. Furthermore, the vacuum cleaner can be moved while lifting it by the shoulder belt 320.

Figure 30:
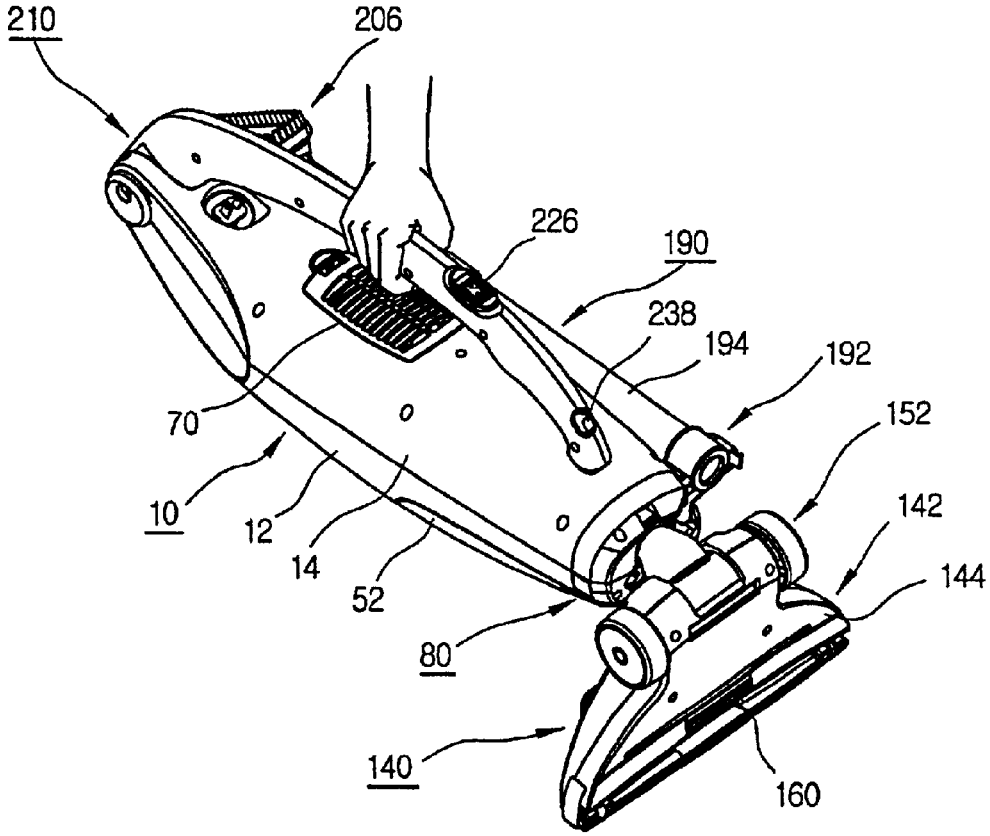
FIG. 30 is a perspective view showing a state of lifting the vacuum cleaner by the handle.

FIG. 30 is a perspective view showing a state of lifting the vacuum cleaner by the handle.

As shown in FIG. 30, the vacuum cleaner can be moved while holding on to the handle 210 while the handle 10 is fixed to the main body 10. Moreover, the vacuum cleaner can be moved while holding on to the auxiliary handle 242.

Hereinafter, effects of the vacuum cleaner mentioned above will be described.

First, since various cleaning means are attached integrally to the main body, a configuration of the vacuum cleaner is converted suitably for various areas, so a user can use the vacuum cleaner effectively.

Secondly, the vacuum cleaner can be lifted and moved easily by means of the handle, the auxiliary handle, or the shoulder belt.

Thirdly, since the brush head is rotatably connected to the socket by predetermined angles, a direction of the brush head can be changed easily, which improves the operability of the vacuum cleaner.

Fourthly, the positioning protrusion of the socket is supported by the positioning portion of the brush head, thereby the main body can stand stably in an upright position.

Fifthly, noise generated by operation of the motor can be drastically reduced by the specifically shaped exhaust duct and the depressed area provided at the main body.

Finally, a configuration of the cord reel is compact, because the cord outlet is formed integrally therewith. Thus, the vacuum cleaner can be easily assembled, and it will keep the manufacturing cost low.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A vacuum cleaner comprising:

a main body having a suction opening being formed at a lower end thereof and an exhaust grill for exhausting air, the main body having a dust collecting chamber, a driving chamber, and a cord reel chamber which are provided successively by partitions;

a socket being attached to the lower end of the main body and having a connecting opening communicating with the dust collecting chamber;

a first cleaner connected detachably to the socket;

a second cleaner installed hingedly on an outer surface of the socket and connected detachably to the connecting opening of the socket when the first cleaner is detached from the socket;

a motor assembly installed in the driving chamber for providing suction force;

a cord reel installed in the cord reel chamber for winding up a power cord that supplies power to the motor assembly; and a handle fixed hingedly at the upper end of the main body in a retractable manner.

2. The vacuum cleaner according to claim 1, wherein the main body has an area dented into the driving chamber and communicating therewith, the exhaust grill formed at the one side of the dented area, and a grill cover having a plurality of apertures for covering the dented area.

3. The vacuum cleaner according to claim 2, wherein the dented area has a first locking hole at a one side thereof and a first locking protrusion at the other side thereof, and the grill cover has a second locking protrusion on one portion thereof fixed to the first locking hole, a tension lock having a second locking hole on the other portion thereof for being fixed to the first locking protrusion, a first stopper protruding on both sides of the tension lock, and a second stopper protruding toward the tension lock for restricting an operating position of the first stopper.

4. The vacuum cleaner according to claim 1, wherein the socket has a guide groove at a front plane thereof to communicate with the connecting opening for guiding of the second cleaner and a positioning protrusion formed on the front plane, and the first cleaner has a positioning portion formed at an upper surface thereof for supporting the positioning protrusion to restrict the inclination of the main body with respect to the first cleaner, wherein the positioning protrusion has a cut-oft portion at the center portion of the end thereof, and a belt pin is attached to the outwardly exposed cut-off portion.

5. The vacuum cleaner according to claim 1, wherein the first cleaner comprises a brush head having a suction port located at a lower surface thereof and being able to be moved by wheels; an inlet duct communicating with the suction port; a rotary duct being vertically rotatably connected to the inlet duct; a first adaptor being vertically rotatably connected to the rotary duct and communicating detachably with the connecting opening of the socket; and a stopper means for restricting a rotation angle of the first adaptor with respect to the rotary duct.

6. The vacuum cleaner according to claim 5, wherein the brush head comprises a main push plate installed on the upper surface thereof; a sub push plate connected to a connecting shaft fitted to the main push plate and moving integrally with the main push plate; and a first brush installed in an inner part of the brush head to be protruded or be retracted from the lower surface of the brush head depending on a pressing of a main push button, wherein the stopper means comprises a rotation stopper protruding from an outer surface of the rotary duct, and a first stop rib and a second stop rib formed symmetrically at a lower portion of the first adaptor to restrict a moving position of the rotation stopper.

7. The vacuum cleaner according to claim 1, wherein the second cleaner comprises a second adaptor installed hingedly in a guide groove at a front plane of the socket and connected detachably to the connecting opening of the socket; a flexible hose connected to the second adaptor; a joint connected to the hose and having a fining member fined detachably to a clip attached to the main body for fastening the second cleaner to the main body; and a suction pipe connected separably to the joint.

8. The vacuum cleaner according to claim 1, wherein the cord reel comprises a mounting bracket having a base plate installed firmly in the cord reel chamber by a plurality of ribs formed in the cord reel chamber, a hub protruding from a side of the base plate, and a cord outlet formed integrally with the base plate for accommodating the power cord; a guide roller installed rotatably between the hub and the cord outlet for guiding the power cord passing through the cord outlet; and a bobbin installed rotatably on the hub for winding up the power cord guided by the guide roller.

9. A vacuum cleaner according to claim 8, wherein the cord outlet has a cut portion at a portion thereof for inserting the power cord into the cord outlet, and the guide roller has an annular guide flange at an end portion thereof for preventing the power cord from escaping from the guide roller.

10. The vacuum cleaner according to claim 1, wherein the handle comprises a stick handle; a bracket fitted to an end portion of the main body for fastening hingedly an end of the stick handle to the main body; a locking means for fitting detachably the other end of the stick handle to an outer surface of the main body; and a stopper means for controlling a foldable position of the stick handle with respect to the main body.

11. A vacuum cleaner according to claim 10, wherein the handle has a power switch electrically connected to a terminal box, the power switch controlling an operation of the vacuum cleaner by controlling an operation of the terminal box.

12. The vacuum cleaner according to claim 1, further comprising an exhaust duct for guiding air from the driving chamber to the exhaust grill, wherein the exhaust duct has an inlet for sucking the air in the driving chamber into the exhaust duct; an outlet connected to the exhaust grill for exhausting the sucked air; and a curved portion between the inlet and outlet surrounding the motor assembly at a predetermined distance apart for disconnecting the exhaust grill from the motor assembly.

13. The vacuum cleaner according to claim 1, further comprising at least one dust filtering means installed in the main body for filtering air.

14. The vacuum cleaner according to claim 13, wherein the dust filtering means comprises a dust bag installed in the dust collecting chamber to communicate with the connecting opening; a first filter installed between the dust collecting chamber and the driving chamber; and a second filter installed in an area dented into the driving chamber.

15. The vacuum cleaner according to claim 1, further comprising an auxiliary handle fixed to an outer surface of the main body for lifting the vacuum cleaner to carry it.

16. The vacuum cleaner according to claim 1, further comprising a shoulder belt fitted to a predetermined position for lifting the vacuum cleaner onto user's shoulder to carry it, wherein the shoulder belt comprises a belt hung on user's shoulder; a hook attached to an end of the belt and connected to a belt pin attached to a positioning protrusion formed on a front plane of the socket; and a buckle attached to the other end of the belt and connected to an auxiliary handle fixed to an outer surface of the main body.

* * * * *